US007845017B2

(12) United States Patent
Godshaw et al.

(10) Patent No.: US 7,845,017 B2
(45) Date of Patent: Dec. 7, 2010

(54) KNEE PAD CONSTRUCTIONS

(75) Inventors: Donald E. Godshaw, Evanston, IL (US); Andrezj M. Redzisz, Wheeling, IL (US); Du Hai, Fujian Province (CN); Brad L. Schantz, Evanston, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 190 days.

(21) Appl. No.: 11/679,021

(22) Filed: Feb. 26, 2007

(65) Prior Publication Data

US 2007/0163025 A1 Jul. 19, 2007

Related U.S. Application Data

(63) Continuation-in-part of application No. 10/943,347, filed on Sep. 17, 2004, now Pat. No. 7,376,978, which is a continuation-in-part of application No. 10/926,240, filed on Aug. 25, 2004, now Pat. No. 7,181,770, application No. 11/679,021, which is a continuation-in-part of application No. 11/670,297, filed on Feb. 1, 2007, now Pat. No. 7,451,493.

(51) Int. Cl.
*A41D 13/00* (2006.01)

(52) U.S. Cl. ..... 2/24

(58) Field of Classification Search ..... 2/16, 2/22, 24, 62, 911, 242
See application file for complete search history.

(56) References Cited

U.S. PATENT DOCUMENTS

| | | | |
|---|---|---|---|
| 830,661 | A | 9/1905 | Greshnam |
| 967,004 | A | 8/1910 | Ehikian |
| 1,055,040 | A | 3/1913 | Herron et al. |
| 1,090,446 | A | 3/1914 | Boynton |
| 1,486,308 | A | 3/1924 | Shook |
| 1,571,088 | A | 1/1926 | Buchanan |
| 2,195,817 | A | 4/1940 | Johnson |
| 2,418,197 | A | 4/1947 | Sherer |
| 2,626,394 | A | 1/1953 | Davis |
| 2,759,189 | A | 8/1956 | Cole |
| 3,465,365 | A | 9/1969 | Jones et al. |
| 3,587,572 | A | 6/1971 | Evans |
| 3,728,736 | A | 4/1973 | Pugh |

(Continued)

FOREIGN PATENT DOCUMENTS

DE 43 26 433 C1 4/1995

OTHER PUBLICATIONS

The Home Deport; Ad # 63693/63698; May-Jun. 2004, one page.

(Continued)

*Primary Examiner*—Tejash Patel
(74) *Attorney, Agent, or Firm*—Fitch, Even, Tabin & Flannery

(57) ABSTRACT

Protective knee pads are comprised of a first shell member which fits over the patella and knee joint and a second member which is attached to the lower thigh and pivotally engaged with the knee pad shell so that they may articulate one with respect to the other while providing additional support and protection for the user of the knee pad. An additional shin pad may also be attached to the lower end of the shell which covers the knee.

19 Claims, 37 Drawing Sheets

U.S. PATENT DOCUMENTS

| | | | | | |
|---|---|---|---|---|---|
| 3,735,419 | A | | 5/1973 | Byrd | |
| 3,772,704 | A | | 11/1973 | Carbonneau | |
| 4,116,236 | A | | 9/1978 | Albert | |
| 4,287,885 | A | | 9/1981 | Applegate | |
| 4,493,316 | A | * | 1/1985 | Reed et al. | 602/16 |
| 4,507,804 | A | | 4/1985 | Consigny | |
| 4,681,012 | A | | 7/1987 | Stelma et al. | |
| 4,686,969 | A | * | 8/1987 | Scott | 602/26 |
| 4,692,946 | A | | 9/1987 | Jurga | |
| D297,178 | S | | 8/1988 | Jurga | |
| 4,893,355 | A | | 1/1990 | Ritter | |
| 5,031,240 | A | | 7/1991 | Nierhaus | |
| 5,301,370 | A | | 4/1994 | Henson | |
| 5,334,135 | A | | 8/1994 | Grim et al. | |
| 5,347,657 | A | | 9/1994 | Unsell | |
| 5,500,955 | A | | 3/1996 | Gongea | |
| 5,524,292 | A | | 6/1996 | Hargens | |
| 5,537,689 | A | | 7/1996 | Dancyger | |
| 5,658,243 | A | * | 8/1997 | Miller et al. | 602/26 |
| 5,711,029 | A | | 1/1998 | Visco et al. | |
| 5,760,868 | A | | 6/1998 | Jannard et al. | |
| 5,794,261 | A | | 8/1998 | Hefling | |
| 6,128,779 | A | | 10/2000 | Goldsmith et al. | |
| 6,223,350 | B1 | | 5/2001 | McFarlane | |
| 6,253,376 | B1 | | 7/2001 | Ritter | |
| 6,279,160 | B1 | | 8/2001 | Chen | |
| D473,977 | S | | 4/2003 | Lesosky | |
| 6,584,616 | B2 | | 7/2003 | Godshaw et al. | |
| 6,820,279 | B2 | | 11/2004 | Lesosky | |
| 6,832,390 | B1 | | 12/2004 | Kleinert et al. | |
| 7,181,770 | B2 | | 2/2007 | Godshaw | |
| 7,376,978 | B2 | | 5/2008 | Godshaw | |
| 7,451,493 | B2 | | 11/2008 | Godshaw | |
| 2004/0111780 | A1 | | 6/2004 | Lesosky | |

OTHER PUBLICATIONS

Professional I-Gel Kneepads, Item No. 433003, downloaded from URL http://www.irwin.com/irwin/consumer/jhtml/detail.jhtml?prodld=lrwinProd100523, downloaded Apr. 2007, one page.

Rubbermaid Professional Kneepads, No. 9H10, downloaded from URL http://images.google.com/imgres?imgurl=http://www.rcpworksmarter.com/rcp/ObjectServer%3Ftable%3DImages%26id%3D21422&imgrefurl=http://www.rcpworksmarter.com/rcp/products/subcategory.jsp%3FcategoryID%3D3%26subcategoryID%3D65%26print%3Dtrue&h=185&w=185&sz=31&hl=en&start=158&um=1&tbnid=oUE5AjGoUC_6xM:&tbnh=102&tbnw=102&prev=/images%3Fq%3Dkneepads%26start%3D140%26ndsp%3D20%26svnum%3D10%26um%3D1%26hl%3Den%26sa%.

Knee-Pad—Black Gel Cap, Item No. 0CC121, downloaded from URL http://www.discountsafetygear.com/knpadblgelca.html, downloaded Apr. 2007, one page.

Bucket Boss Air-Gel 2 Kneepads, Item No. 171927, downloaded from URL http://www.northerntool.com/webapp/wcs/stores/servlet/product_6970_200313953_200313953, downloaded Apr. 2007, two pages.

Professional Gel Kneepads, Product No. G340, downloaded from URL http://www.clccustomleathercraft.com/products/detail002.asp?partNo=G340, downloaded Apr. 2007, two pages.

Black Diamond Telekneesis Kneepad, Item No. BLD0697, downloaded from URL http://www.backcountry.com/store/BLD0697/?view_large_image=1&swatch=TKBK, downloaded Sep. 4, 2007, one page.

Dainese Women's Knee Guard, downloaded from URL http://www.nollie.tv/2007/01/dainese_womens_.html, downloaded Sep. 11, 2007, one page.

Dainese: Snow Elbow Guard Evo, Article No. 17667, downloaded from URL http://www.hot-zone.tv/store/snow-elbow-guard-black-p-17667-.html?manufacturers-id=32 . . . , downloaded Sep. 4, 2007, one page.

Knee Pro Knee Armor by Dainese, downloaded from URL http://www.motoliberty.com/prod_detail.asp?Prod_ID=95, downloaded Sep. 4, 2007, one page.

3 Strap Velcro, downloaded from URL http://www.argentinapolo.com/images/picKneePad3strap.JPG, downloaded Sep. 4, 2007, one page.

BlackHawk Hellstorm Advanced Tactical Kneepads w/Rivet Capo, SKU 802500OD, downloaded from URL http://www.tactical-store.com/printable-ts-bw-un-802500od.html, downloaded Sep. 4, 2007, one page.

Mechanix Standard Knee Pad, Item No. MKP05-600, downloaded from URL http://www.tasco-safety.com/workgloves/mechanix-knee-pads.html, downloaded Sep. 4, 2007, one page.

Mechanix Deluxe Team Issue Knee Pad, Item No. MKPP-05-700, downloaded from URL http://www.tasco-safety.com/workgloves/mechanix-knee-pads.html, downloaded Sep. 4, 2007, two pages.

Freedom® Comfort™ OAKneww Orthosis, SKU 64316, downloaded from URL http://www.easierliving.com/ProductDetail.asp?style=64316&print=Y, downloaded Sep. 4, 2007, one page.

MX-2 Knee Brace, Adult Left Model No. 6404-21-530, Adult Right Model No. 6404-22-530, downloaded from URL http://www.sixsixone.com/Catalog_661Bike.aspx?id=a5ef2024-eff9-4582-b3a0-4032d148a . . . , downloaded Sep. 4, 2007, one page.

Motocross kneepads, Feb. 2007, one page.

The Knee Pro Ultra Flex III (TM), downloaded from URL http://www.kpindustries.com, Feb. 2007, one page.

* cited by examiner

KNEE PAD CONSTRUCTIONS

CROSS REFERENCE TO RELATED APPLICATIONS

This is a continuation in part application of Ser. No. 10/943,347, filed Sep. 17, 2004, now U.S. Pat. No. 7,376,978 entitled "Knee Pad Construction" which is a continuation in part application of Ser. No. 10/926,240, filed Aug. 25, 2004, entitled "Knee Pad Construction", now U.S. Pat. No. 7,181, 770 and Ser. No. 11/670,297, filed Feb. 1, 2007, now U.S. Pat. No. 7,451,493 entitled "Knee Pad Construction", each of which priority is claimed and which is incorporated herewith by reference.

BACKGROUND OF THE INVENTION

In a principal aspect, the present invention relates to protective knee pad constructions and, more particularly, to pairs of knee pads for workmen which are constructed to cover and protect the lower thigh, knee and upper shin of a workman.

Protective knee pads are used by various individuals; for example, construction workers, mechanics, sportsmen, athletes, and others who find it necessary to protect their knees as a result of their work or activities, particularly when kneeling on a hard surface. Utilization of protective knee pads placed on or around the knee for use when kneeling on hard surfaces is thus a common practice and, in some instances, a requirement in order to effectively engage in a trade or craft. Various knee pad constructions are available and they typically comprise a rigid case or outer shell which is padded on the inside surface, is shaped to be fitted over the knee and includes attachment straps for retention on or over the knee.

Knee pad constructions are the subject of various prior patents and applications including U.S. Pat. No. 6,584,616 B2 issued Jul. 1, 2003 and incorporated herewith by reference. Further knee pad constructions are disclosed in U.S. Pat. No. 6,223,350 for a Molded Knee Pad Construction in U.S. Pat. No. 5,031,240 for a Knee Pad; U.S. Pat. No. 5,794, 261 for a Protective Joint Guard; U.S. Pat. No. 5,537,689 for a Protective Knee Pad Having a Single Piece Cupping Means and Stitch Receiving Groove; U.S. Pat. No. 5,500,955 for a Knee Pad for Athletes; U.S. Design Patent No. D473,977 for a Knee Pad; and U.S. Patent Publication No. US2004/0111780 for a Knee Pad.

One problem associated with the use of knee pads relates to a situation where the pad will tend to slip or move while the workman or individual using the pad is changing positions; for example, moving from a standing to a kneeling position. To overcome this problem, various types of strap constructions have been proposed. While such solutions have their benefits, they are not necessarily acceptable in all circumstances.

Another problem often observed with protective knee pads for workman and others is associated with the shape or form of the knee pad. Often the knee pad, as a result of its configuration, will tend to bind or cut into the shin or thigh of a workman when moving or when changing from one position to another. These, among other issues, have been considered vexing to various workman and others needing protective knee pads.

SUMMARY OF THE INVENTION

Briefly, the present invention comprises a knee pad construction which includes a first shell designed to fit over and protect the patella or knee of a workman. The first shell is coupled to a second member such as a strap or other construct, which is designed to engage or fit on the thigh of a workman and simultaneously be connected to or joined to the first shell shaped knee pad section. The combination of the protective first knee shell and the second thigh member provide extra protection for the user of the knee pad. The two elements or members, namely the knee pad for the protection of the knee and the thigh member, are hinged together and thus may articulate one with respect to the other.

The thigh construct or member includes a portion thereof which may slide over the knee pad and thus, will shield the knee and provide protection, regardless of the degree of articulation of the component parts. Various means are utilized to connect the thigh construct or member with the knee pad, including linkage members as well as connecting wings associated with the thigh member. Further, an additional protective shin guard may be coupled to the lower end of the knee pad or knee shell element.

Straps are used to attach each of the described member elements of the knee pad assembly to the appropriate portion of a leg of a workman or individual using the knee pads. The knee pad shell, or portion of the device which protects the knee or patella, is typically convex in shape with the interior side being relatively concave so as to comfortably fit over the knee of an individual. The interior is typically padded. The exterior of the knee shell may be fabricated in a number of forms. Thus, it may include a flat or ribbed surface to facilitate balance by the user of the knee pads. Most typically, the exterior surface is formed from a hard polymeric material or hard rubber or similar material and the surface thereof is generally flat or includes an appropriate shape and pattern of ribs to facilitate balance and utility by the workman.

Thus, it is an object of the invention to provide improved knee pad constructions.

It is a further object of the invention to provide a knee pad construction which combines a concave elastic cushion member with a convex knee protection shell in combination with an attached or attachable thigh element or construct or member, which articulates with respect to the knee shell or knee protection element or member.

Another object of the invention is to provide a knee pad construction which will facilitate simultaneous protection of the lower thigh, the knee and the upper shin of a workman or user.

Another object of the invention is to provide a knee pad construction wherein a thigh member fitted over the lower thigh is attached to and articulates with respect to a knee pad construct that covers and protects the knee.

A further object of the invention is to provide a knee pad construction which is rugged, economical, easy to use, lightweight and capable of use for protection of a wide variety of knee sizes and shapes.

These and other objects, advantages and features of the invention will be set forth in the detailed description which follows.

BRIEF DESCRIPTION OF THE DRAWING

In the detailed description which follows reference will be made to the drawing comprised of the following Figures:

FIGS. 1-4 comprise a first embodiment of the invention wherein FIG. 1 is a side view of the first embodiment as fastened onto the thigh and the knee of an individual;

FIG. 2 is an isometric view of the knee pad construction of FIG. 1;

FIG. 3 is a plan view of the knee pad construction of FIG. 1;

FIG. 4 is a side view of the knee pad construction of FIG. 1;

FIGS. 5-13 depict a second embodiment of the invention wherein FIG. 5 is a side view of the embodiment as positioned on a leg of an individual and fitted over the knee;

FIG. 6 is a side view of the knee pad of FIG. 5 as depicted from the opposite side of FIG. 5;

FIG. 7 is a plan view of the knee pad of FIG. 5 as viewed from the top side or outside face thereof;

FIG. 8 is a plan view of the knee pad of FIG. 7 as viewed from the opposite side thereof;

FIG. 9 is a plan view of the outer hard shell of the knee pad of FIG. 5;

FIG. 10 is a back side view of the hard shell of FIG. 9;

FIG. 11 is a plan view of the back side of the shell of FIG. 10 illustrating the addition of a cushioning element;

FIG. 12 is a plan view of the back side of the construction of FIG. 11 further incorporating a pad member;

FIG. 13 is an exploded plan view of the component parts for attaching a thigh support band or strap to the knee covering element or shell;

FIGS. 14-20 illustrate a third embodiment of the invention wherein FIG. 14 depicts the embodiment affixed to a leg of an individual;

FIG. 15 is a side view of the knee pad construction of FIG. 14;

FIG. 16 is an opposite side view from that of FIG. 15 depicting the knee pad construction;

FIG. 17 is a front plan view of the knee pad of FIG. 14;

FIG. 18 is a back side plan view of the knee pad construction of FIG. 17;

FIG. 19 is a back side plan view of the knee pad of FIG. 18 wherein components thereof are folded;

FIG. 20 is a plan view of the back side of a knee pad construction similar to FIG. 19 illustrating the folding thereof;

FIGS. 21-26 illustrate a further embodiment of the invention wherein FIG. 21 illustrates the embodiment as positioned on the thigh and knee of an individual;

FIG. 22 is a side elevation of the knee pad construction of FIG. 21 wherein the leg of the individual has been generally straightened;

FIG. 23 is an isometric view of the knee pad of FIG. 21 as viewed from the front side thereof;

FIG. 24 is an isometric view of the knee pad of FIG. 23 wherein the straps thereof have been at least partially folded;

FIG. 25 is a side elevation of the knee pad of FIG. 21;

FIG. 26 is a front or front plan view of the knee pad of FIG. 21;

FIGS. 28-34 depict a further embodiment of the invention wherein FIG. 28 illustrates the placement of a knee pad upon a generally upright leg of an individual;

FIG. 29 is a front plan view of the knee pad construction of FIG. 28;

FIG. 30 is a back side plan view of the knee pad of FIG. 28;

FIG. 31 is a back side plan view of the knee pad construction of FIG. 30 wherein the knee pad is depicted in the folded condition;

FIG. 32 is a back side plan view of the knee pad construction of FIG. 31 wherein the straps thereof are depicted in a partially folded condition for purposes of storage, packaging and the like;

FIG. 33 is a back side plan view of the knee pad construction of FIG. 32 wherein the straps are further folded for purposes of storage, packaging and the like;

FIG. 34 is a front side plan view of the folded knee pad construction of FIG. 33;

FIGS. 35-37 comprise a further embodiment of a knee pad construction of the invention wherein FIG. 35 is a front side plan view thereof;

FIG. 36 is a side view of the knee pad construction of FIG. 35; and

FIG. 37 is a front plan view of the knee pad construction of FIG. 35 wherein the straps are in a folded condition on the back side thereof.

DETAILED DESCRIPTION OF EMBODIMENTS OF THE INVENTION

Figure 1:
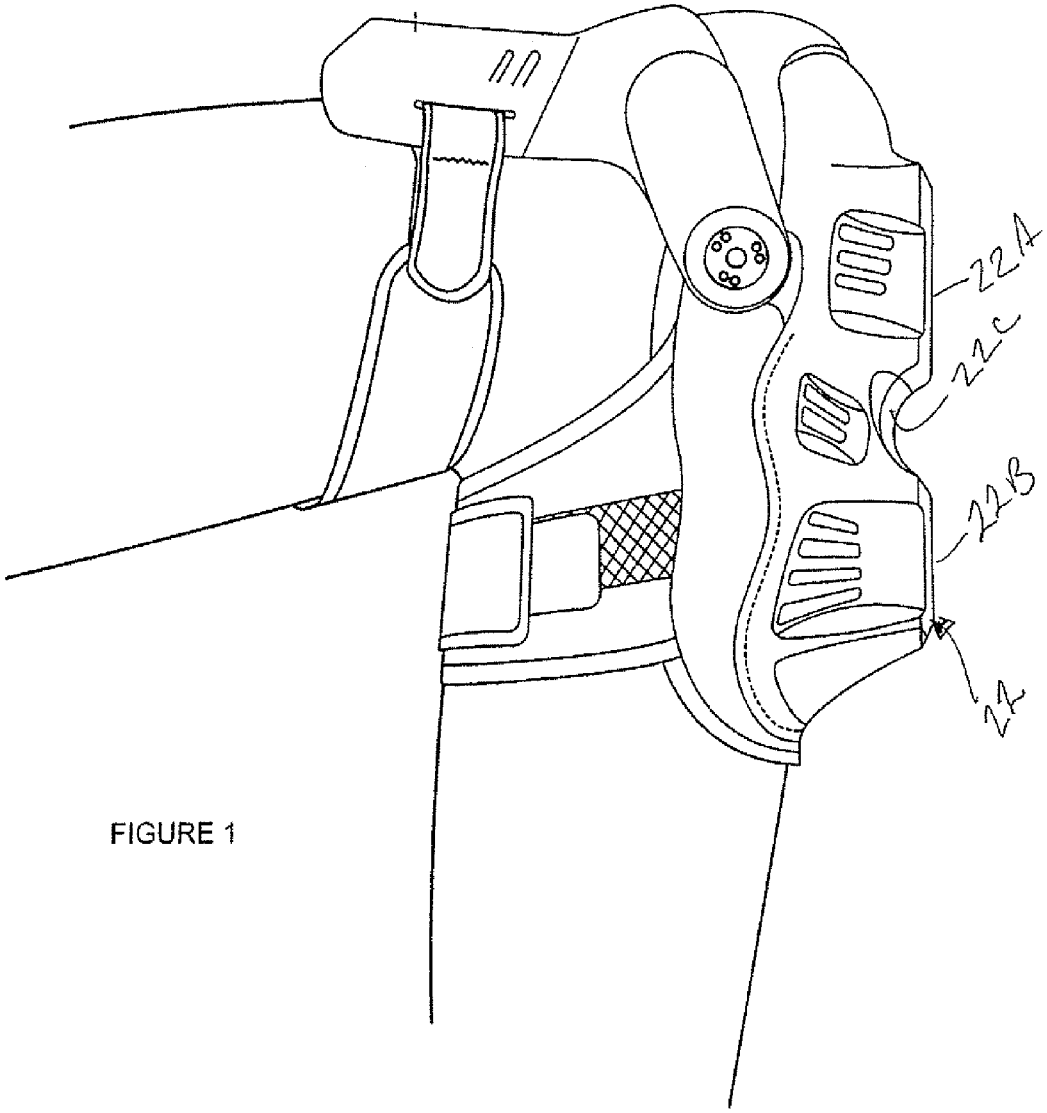
Figure 2:
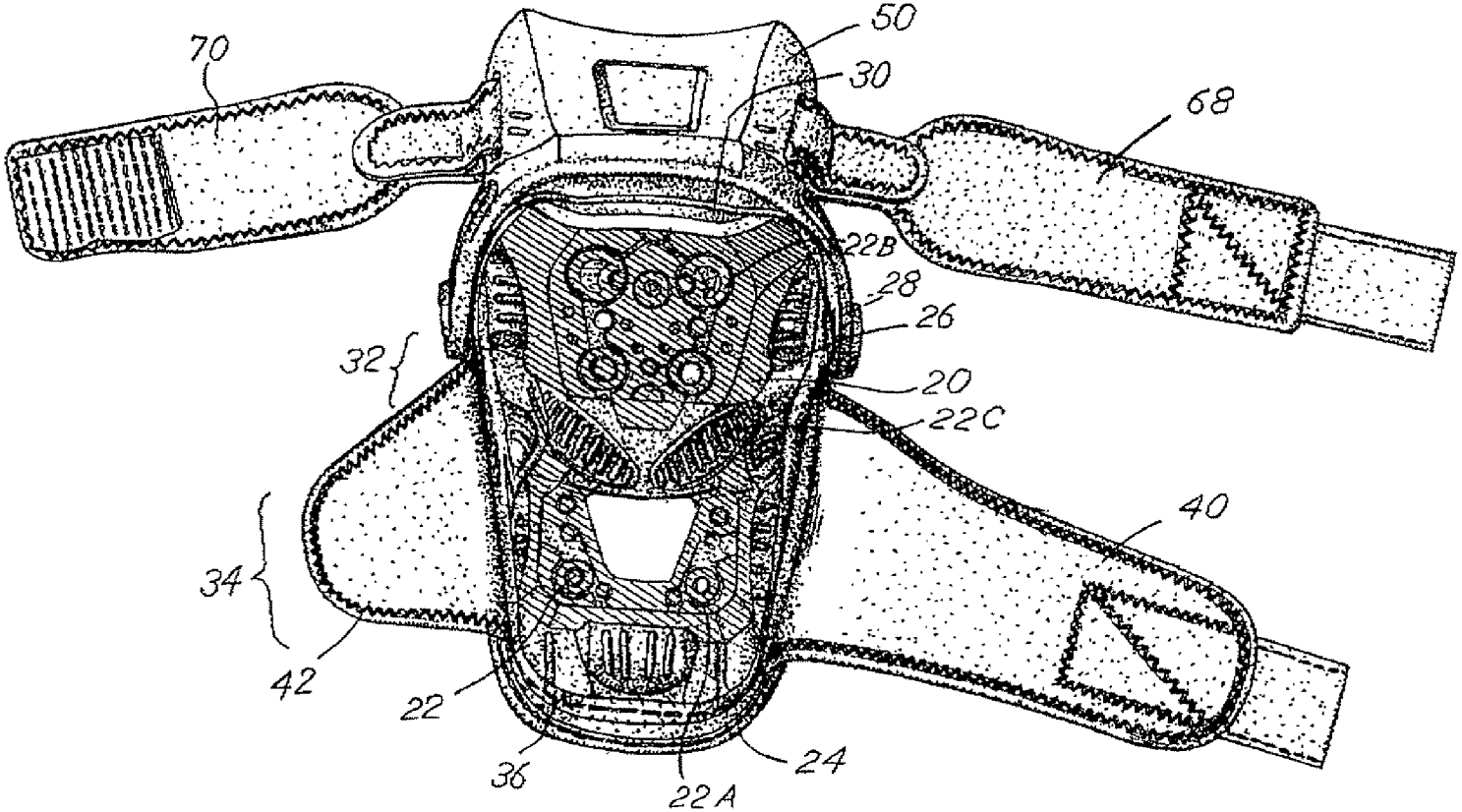
Figure 3:
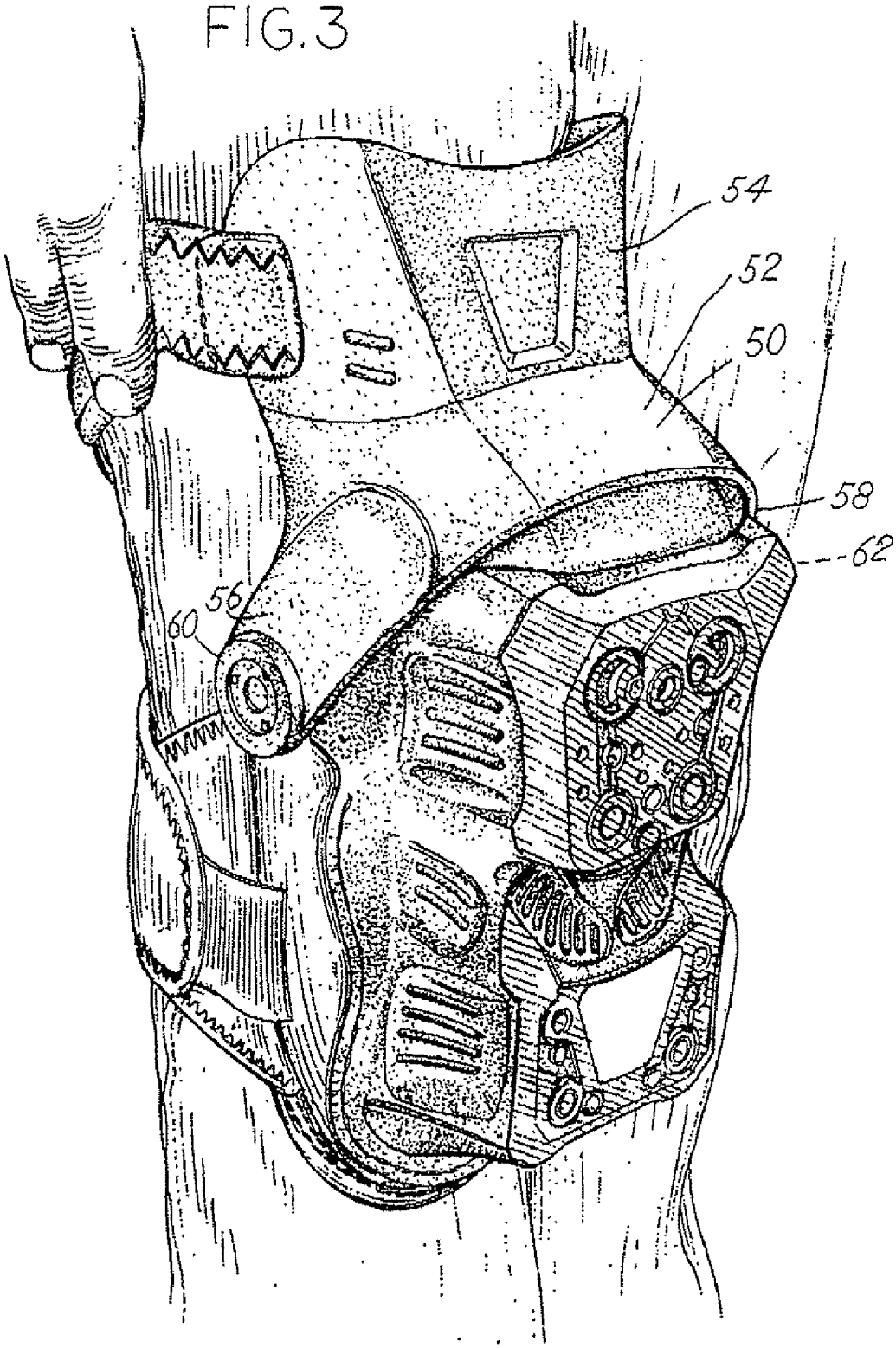
Figure 4:
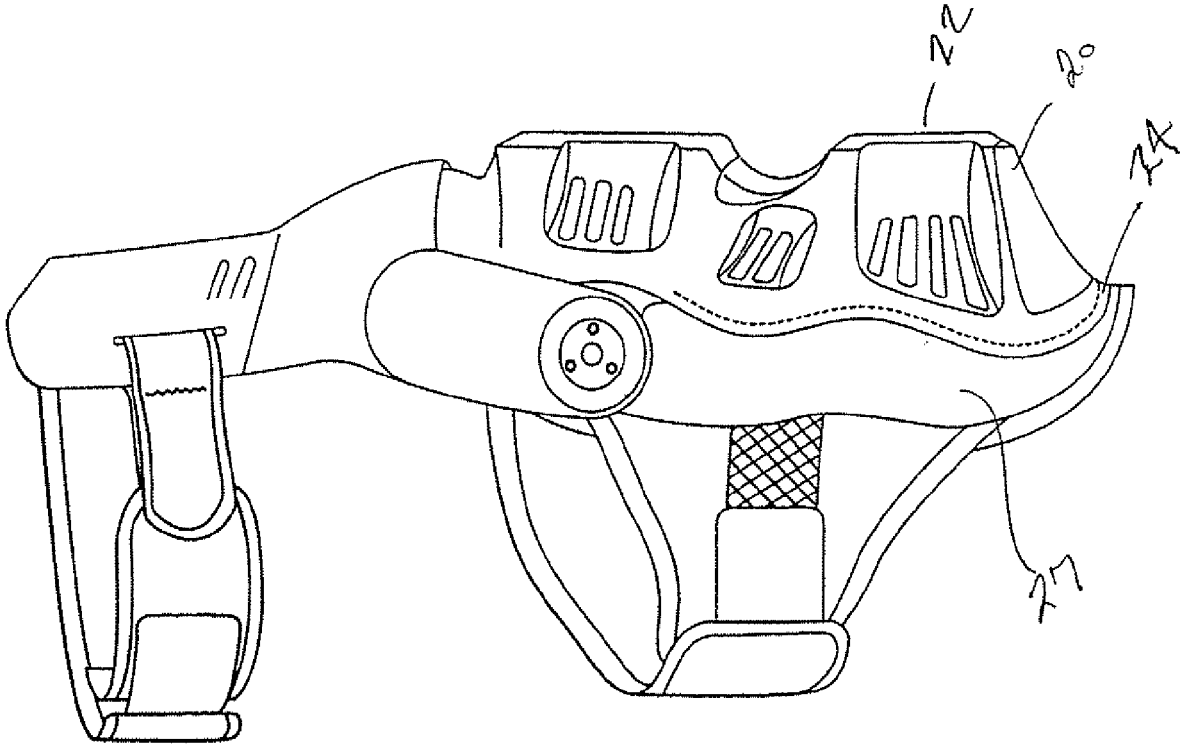
Figure 5:
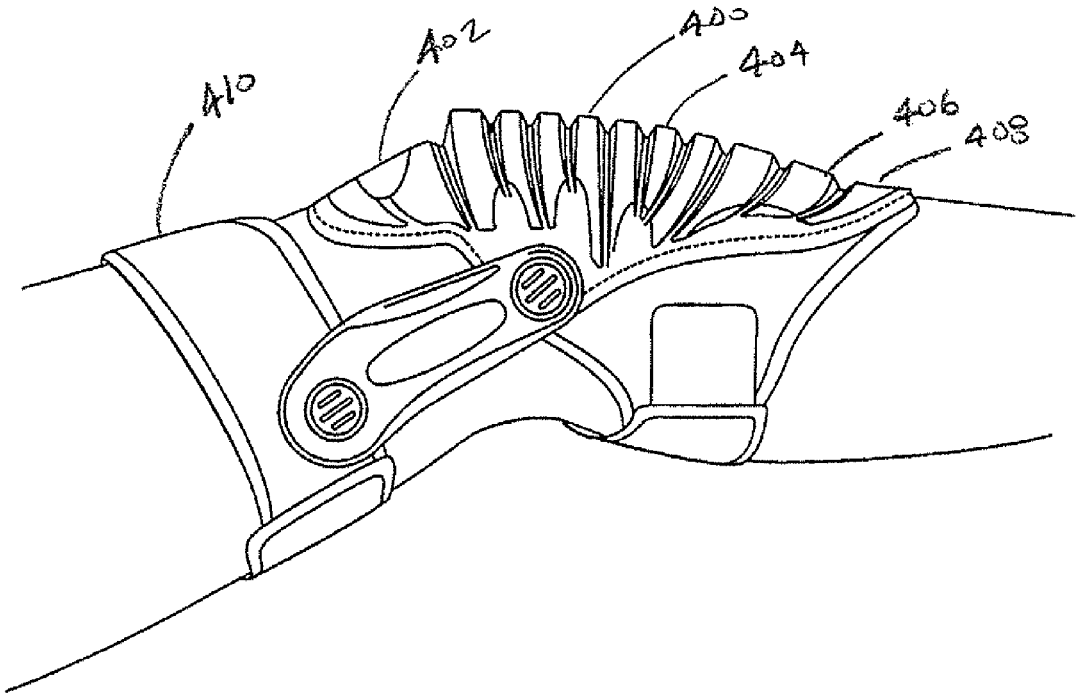
Figure 6:
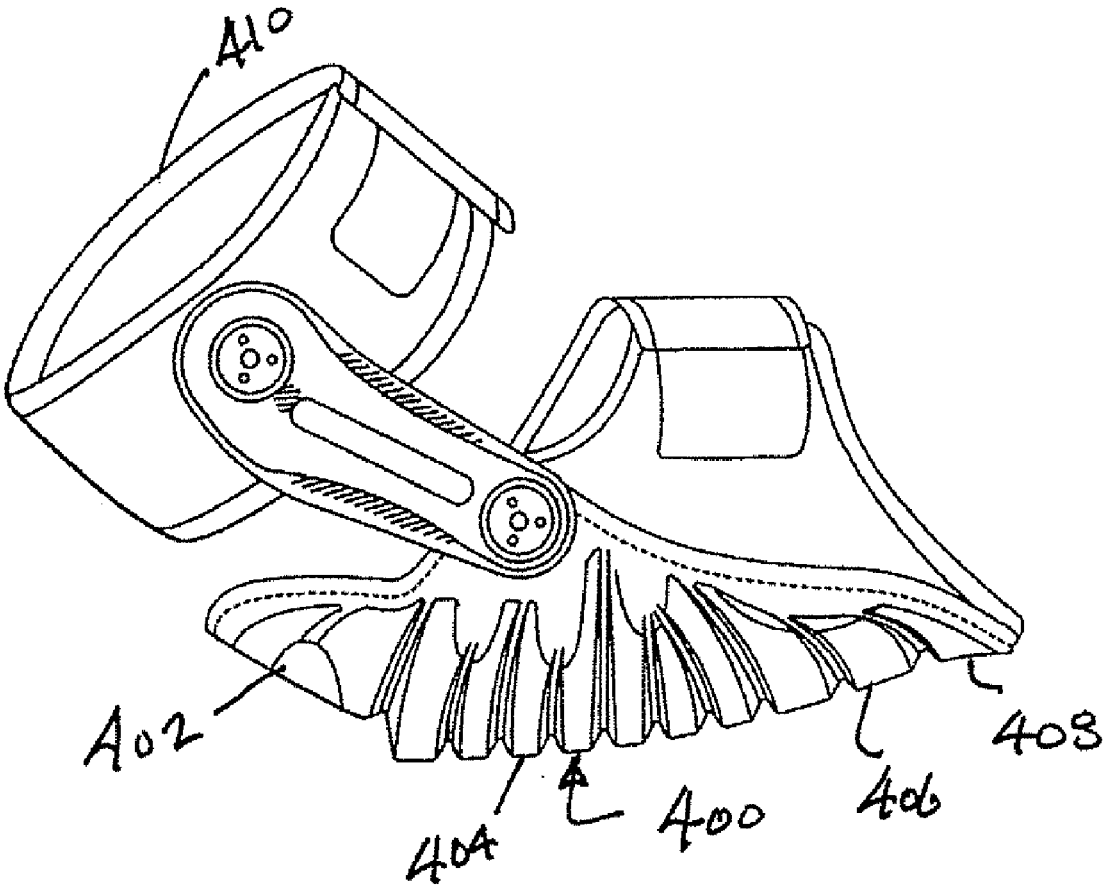
Figure 7:
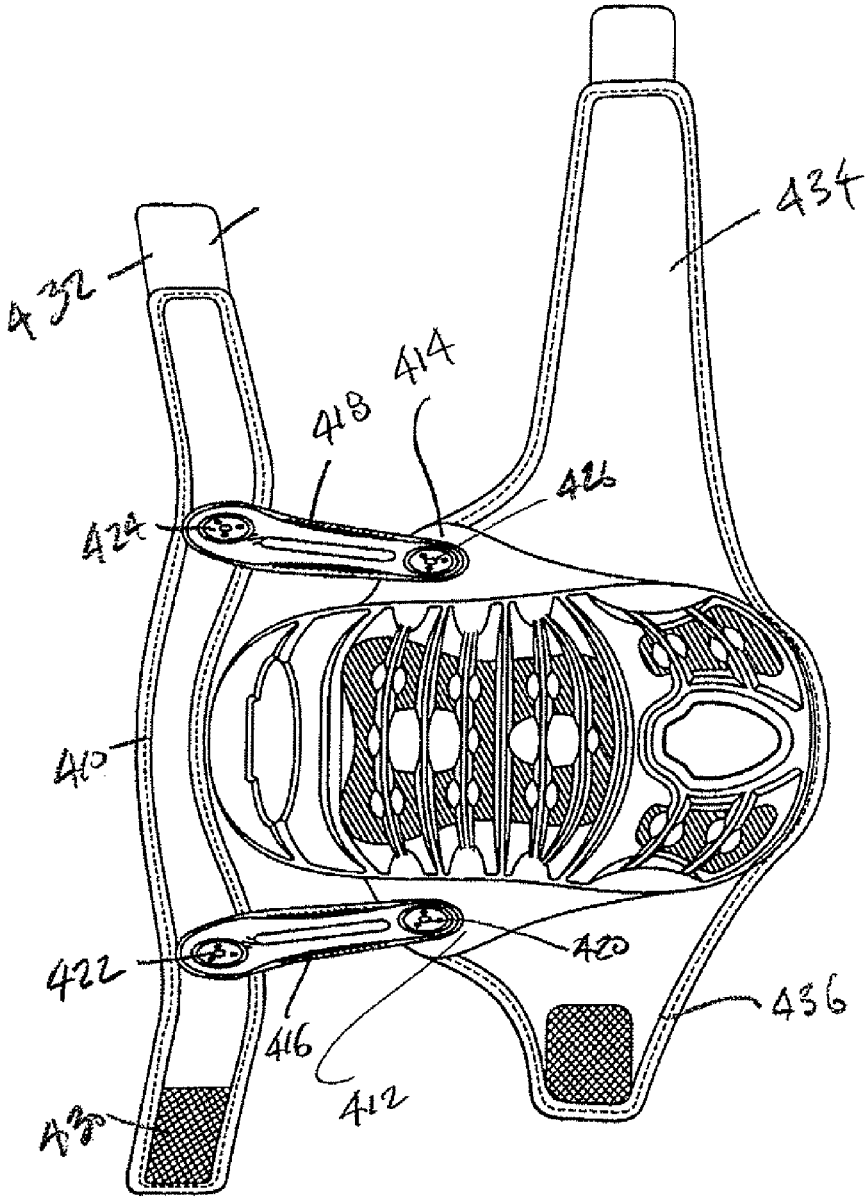

FIGS. 1-4 illustrate features associated with a first embodiment of the invention. The embodiment of FIGS. 1-4 comprises a protective knee pad which includes a first generally rigid, formed knee protection shell 20. The shell 20 includes an outer face 22. It further includes a peripheral edge 24, an inner concave section 26 with layer padding 27 with an optional gel insert 28. The hard shell 20 includes an upper section or end 30, a mid section 32 and a lower section or end 34. The upper side or end 30 is designed to fit over the top of a knee or patella. The mid-section 32 fits directly over the patella. The lower section 34 fits over the upper shin of an individual. The lower end or section 34 is generally cylindrical in shape and the extreme lower end extends outwardly and upwardly away from the shin in the manner of a duck bill 36.

The outer face 22 may have any number of desired forms. It may be generally convex. It may include a surface comprised of various flat sections such as flat section 22A and flat section 22B, separated by a slot or depression 22C. The configuration of the outer face 22 provides a surface such as depicted, for example, in FIG. 1 wherein balance of the workman or individual using the knee pad is facilitated by virtue of the generally flat planar configuration or shape of the composite sections forming outer surface 22. Thus, as illustrated, it may be flat or configured in some other manner that is desired to facilitate utility.

The first generally rigid formed shell 20 includes an attached inner or inside padded layer 27 with attached flexible fabric straps 40 and 42. The straps 40, 42 are attached respectively to the opposite, lateral side or peripheral edges 24 of the shell 20 and padding 27 and may be fitted and engaged around the back side of a lower leg or shin to hold the combination shell 20 and padding 27 in place. The straps 40 and 42 are wider or have a greater dimension where they connect to the shell 20 and padding 27 and thus, each strap is positioned to extend between the lower edge or shin section 34 and over the mid section 32 of the shell 20 and padding 27. The outer ends of the strap 40, and the strap 42, are narrower in construction than the portion attached to the shell 20 and padding 27 to facilitate placement thereof on the leg below the knee in a manner which will not bind against the skin on the back side of the knee of a worker when fastened together by a hook and loop fastening mechanism, for example.

The shell 20 includes first and second integrally molded or formed extensions or arms 21, 23 positioned respectively on opposite sides of the shell 20 and extending generally transverse to the front face 22 of shell 20. The arms 21, 23 are generally equally sized and have substantially identical shapes. They are positioned to be generally in horizontal alignment with the knee joint of a person using the knee pad. Such alignment is considered important for assurance of comfort and functionality of the knee pad construction when fastened in position over the knee.

Another feature of the embodiment of FIGS. 1-4 is the inclusion of a second, generally rigid shell or bracket or brace 50. The second shell 50 is designed to fit over the front, lower thigh of an individual and thus includes a generally convex section 52 and an upper generally cylindrical section 54. The convex section 52 fits over the compatibly shaped outside surface of the first shell 20. The second shell 50 includes first and second extensions, arms or side wings 56 and 58, which are disposed on the opposite lateral sides of the lower or convex forward section 52 of the shell 50. The side wings 56, 58 are attached by means of a pivot connection 60 and 62, respectively, to the opposite side arms 21, 23 of the shell 20. The axis 35 of the pivot connections 60 and 62 is transverse to the longitudinal dimension of the knee pad construction and generally is aligned with the knee joint when the knee pad is placed on an individual. This arrangement enables the upper thigh construct or member 50 to comfortably pivot over the lower section or first shell 20. In the embodiment depicted, the thigh shell or member 50 includes a first strap 68 and a second strap 70 connected respectively to the opposite sides thereof. Straps 68, 70 may be joined together to affix or hold the shell 50 on the lower thigh of an individual, as depicted in the figures.

With the knee pad of the embodiment depicted in FIGS. 1-4, the section or shell 50 associated with and connected to the thigh may articulate with respect to the first shell 20 protecting the knee. Thus, a workman may move into a kneeling position and have the lower thigh protected by a hard shell 50, as well as the knee by a hard shell 20. Additionally, the attachment of the lower thigh member or shell 50 has the function of maintaining the knee pad section or shell 20 in position, so that it will not undesirably slip out of position upon movement of the workman. Note the straps 68, 70 fit around the lower thigh and straps 40, 42 fit around the lower leg. The pairs of straps 68, 70 and 40, 42 are thus spaced and do not fit behind the knee joint thereby enhancing comfortable use of the knee pad construction.

FIGS. 5-13 illustrate a further embodiment of the invention. Referring to those figures, the knee pad construction includes a hard outer shell 400 which may be fabricated from a molded polymeric or rubberized material. The hard outer shell 400 includes an upper end or section 402 which is part of the generally convex hard shell 400, a middle section 404 and a lower section 406. The lower section 406 is generally cylindrical and includes an outwardly and downwardly extending front edge or portion 408 which is in the form of a duck bill and will fit against the upper shin of an individual without cutting into the upper shin.

The embodiment of FIGS. 5-13 further includes a thigh strap 410 which is provided to fit around the lower thigh of the leg of an individual. The thigh strap 410 is attached to first and second lateral side wings 412 and 414 of the knee shell 404 by means of first and second connecting links 416 and 418. The connecting links 416 and 418 are generally rigid and molded from a material such as a polymeric or rubberized material. The links 416 and 418 are attached at their opposite ends by means of pivot connections such as pivot connections 420 and 422 connecting the link 416 respectively to the strap 410 and the shell 400. In a similar fashion the link 418 is attached by pivot connections 424 and 426 to the strap 410 and the shell 400. An axis of rotation through the pivot connections 420 and 426 is generally aligned with the pivot axis associated with a knee joint of an individual. The strap 410 includes opposite ends 430 and 432 which may be joined together by means of a hook and loop fastener material, for example. This will maintain the strap 410 tightly about the lower thigh of an individual. In similar fashion, the shell 400 includes a flexible padded, internal cushion material with a strap 434 on one side thereof and a second strap 436 on the opposite side thereof. The straps 434 and 436 may, of course, be joined to hold the knee pad construction on an individual.

Figure 8:
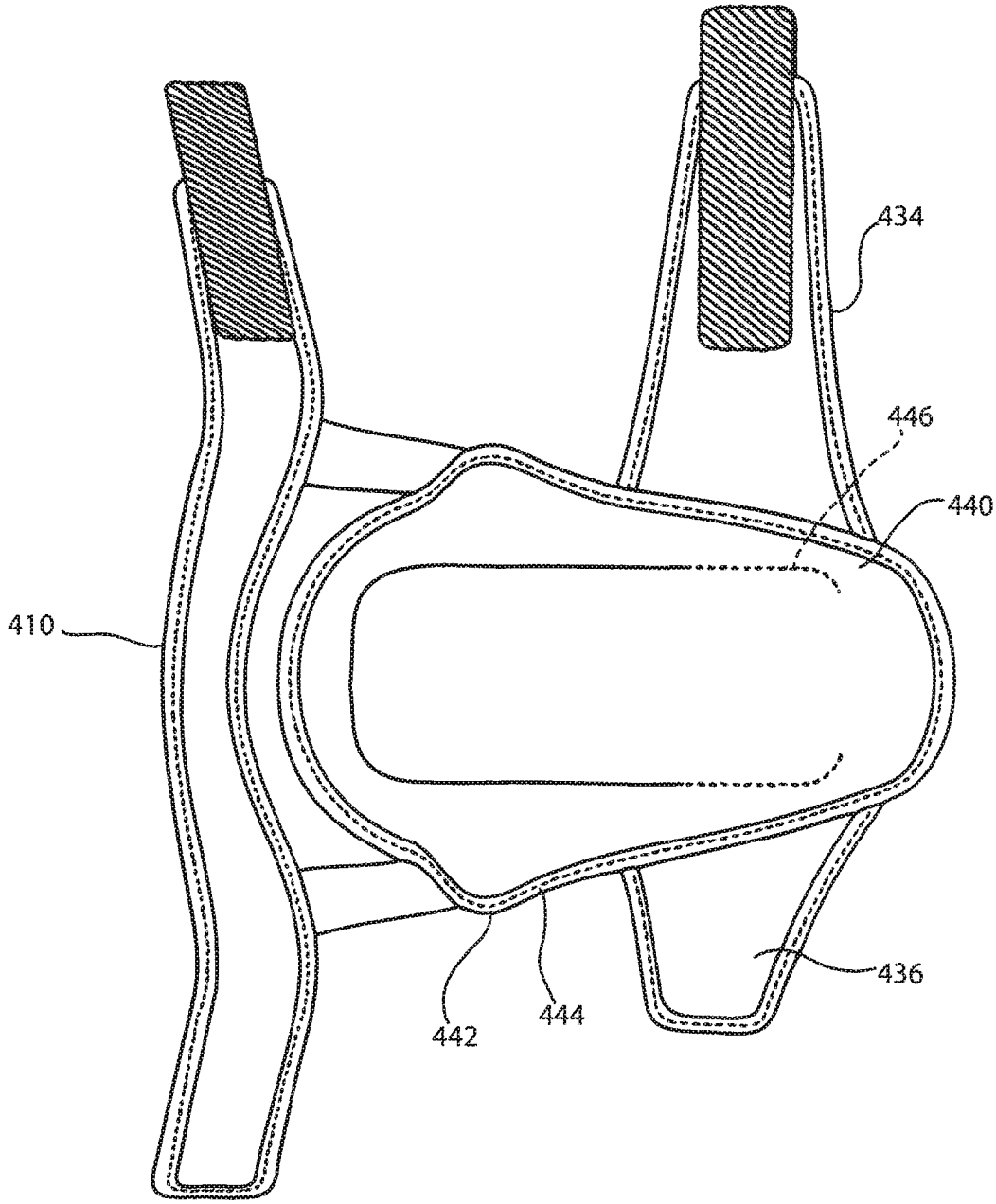

FIG. 8 illustrates the back side of the pad 440 which is engaged and attached to the hard shell 400, for example, by binding 442 which is stitched to the shell 400 by stitching 444. The padding 440 may be fitted over a cushion material 446 on the inside of the shell 400. The straps 434 and 436 are attached to the padding 440 to provide a means for fastening the knee pad construction on the knee of an individual.

Figure 9:
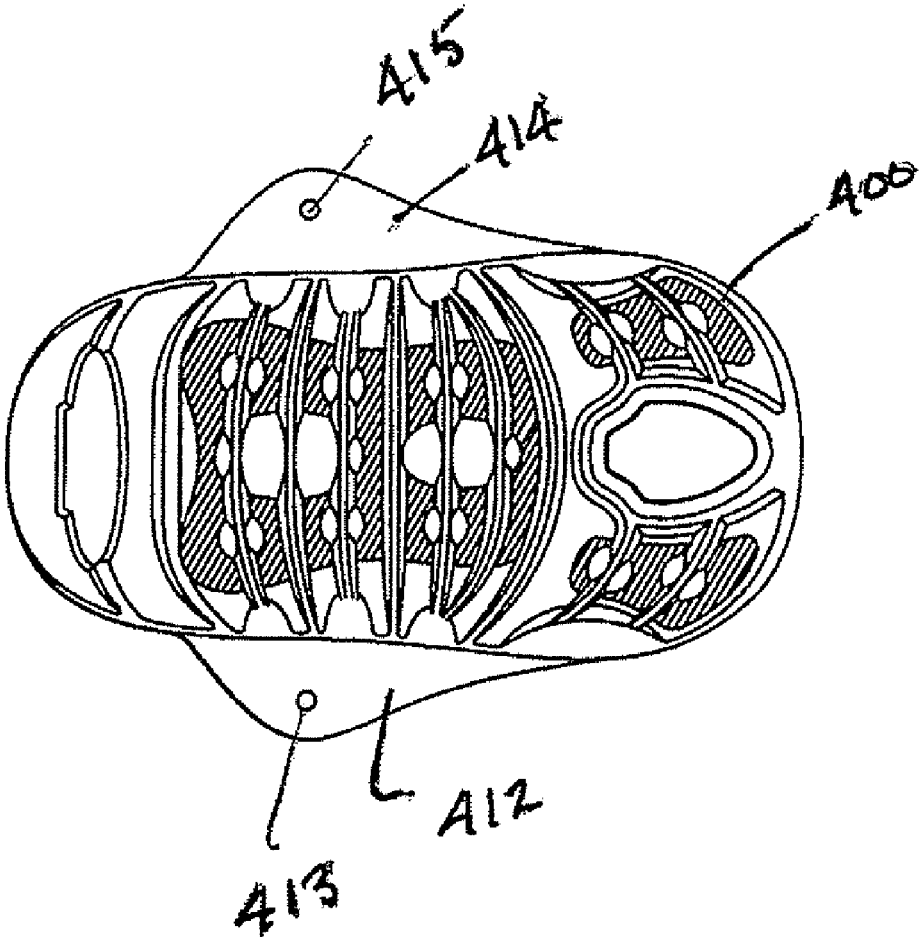
Figure 10:
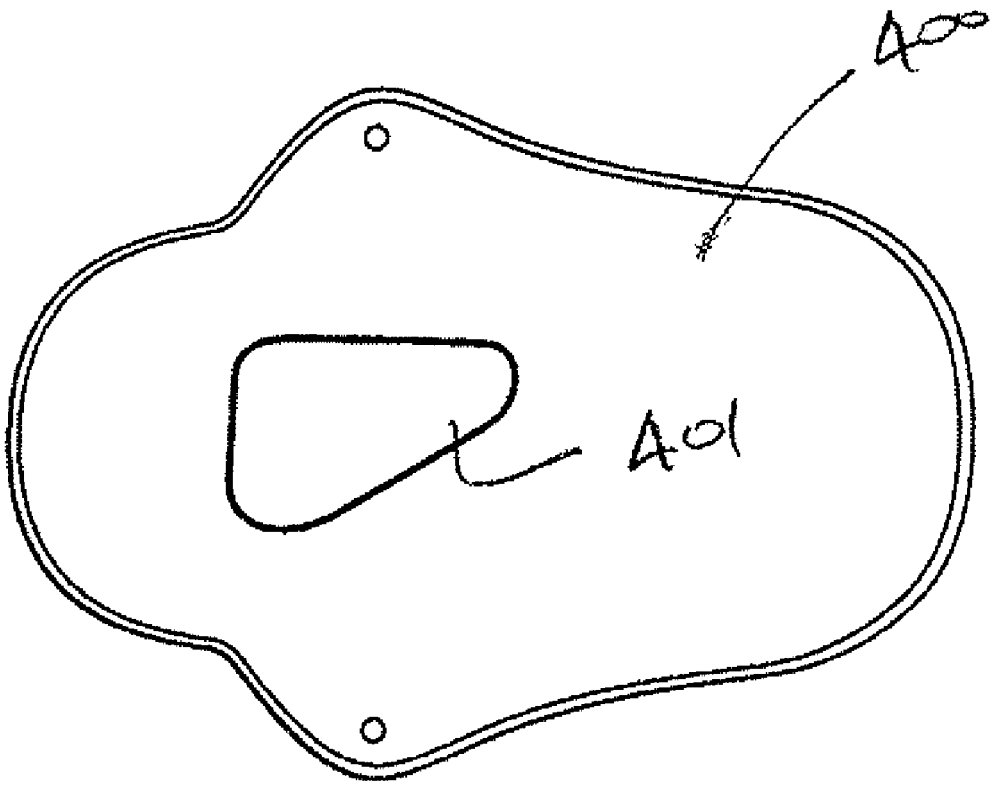

FIGS. 9 and 10 illustrate the construction of a typical shell 400. FIG. 9 depicts the front side thereof wherein opposite side wings 412 and 414 are provided with aligned openings 413 and 415 which are cooperative with the links 416 and 418 as previously described. FIG. 10 illustrates the back side of the shell 400 and more particularly, depicts an internal pocket or groove 401 which is designed to receive a gel insert by way of example as depicted in cross referenced applications incorporated by reference. Thus, when the padding 440 is fitted over the gel insert in the pocket 401 the knee pad will provide enhanced comfort.

Figure 11:
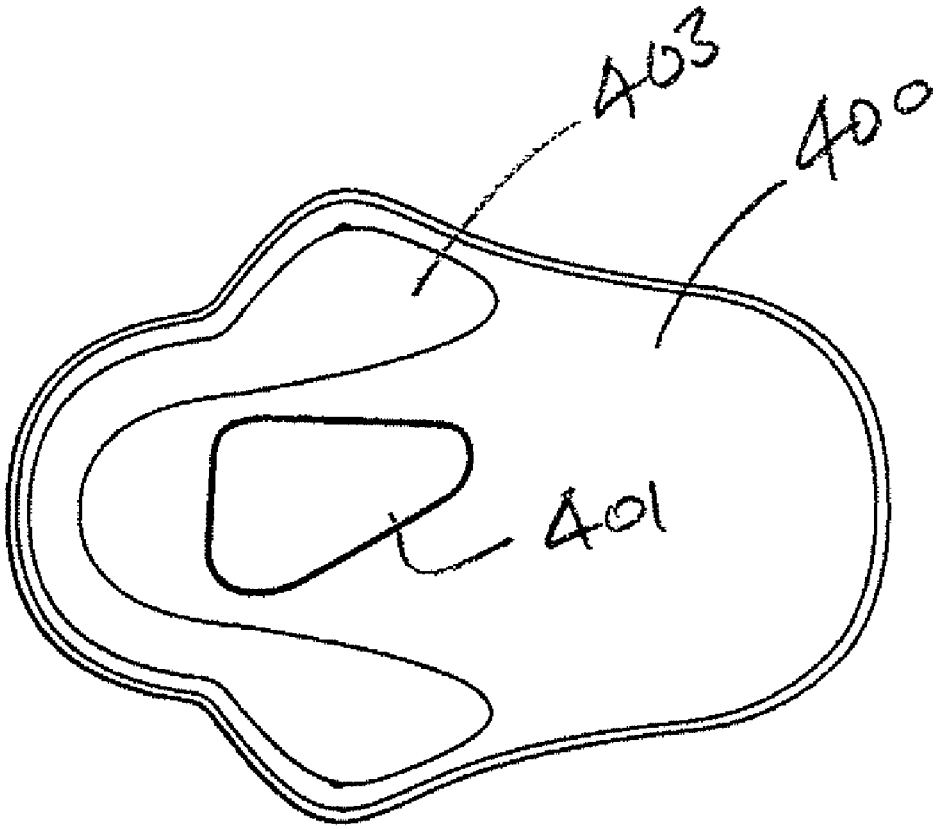
Figure 12:
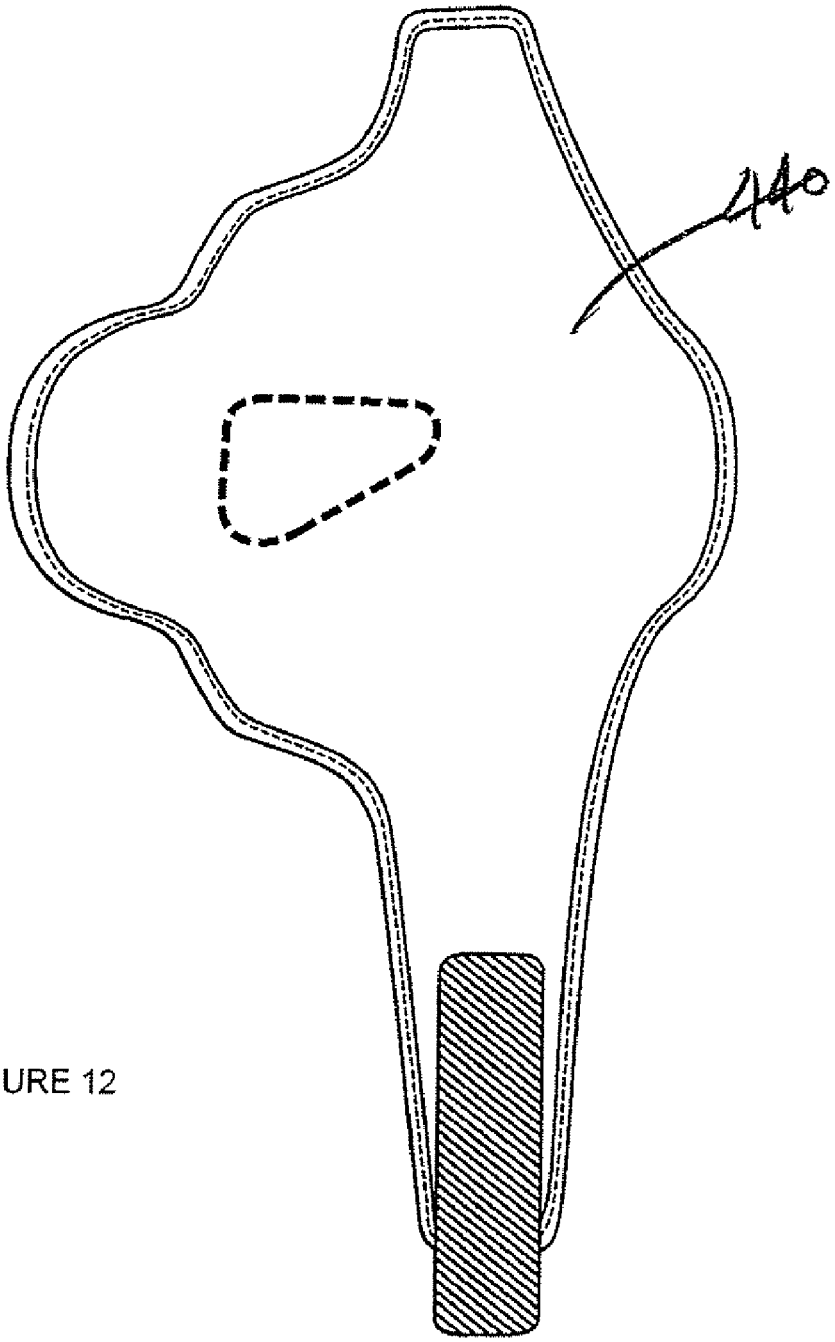

FIG. 11 illustrates the further feature associated with the back side of the shell 400; namely, a partially circumferential cushion element 403 is inserted around the upper periphery of the shell 400 as surrounding the gel insert pocket 401. FIG. 12 depicts the construction of padding material 440 which may be fitted over the inside of the hard shell 400 and attached as previously described by means of a stitching.

Figure 13:
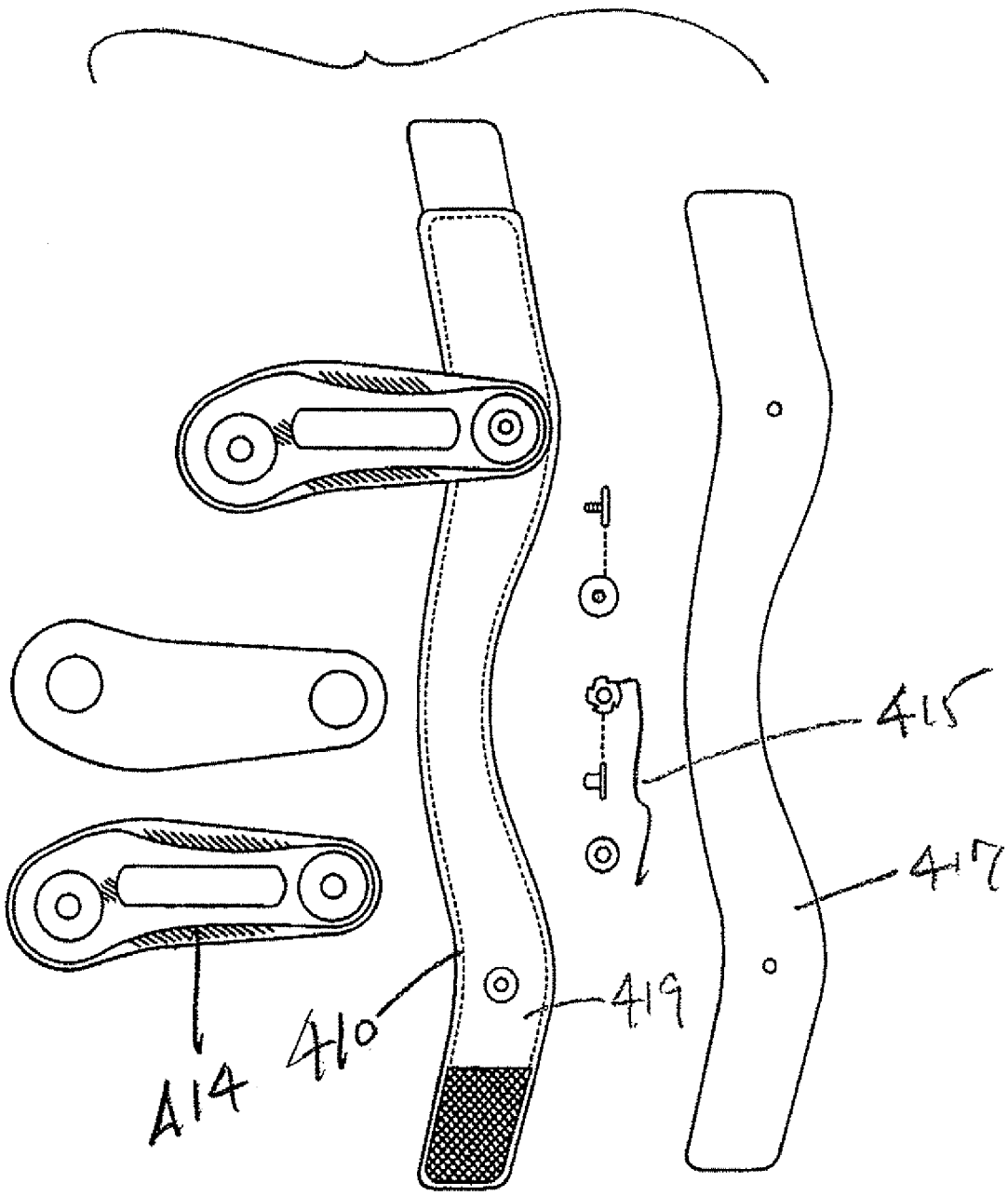

FIG. 13 illustrates an exploded view of the link construction associated with the strap 410. Thus, a link 414 is attached by pivot pins 415 to the strap 410. The strap 410 may include an internal reinforcing band 417 and a cushioned band or element 419.

Figure 14:
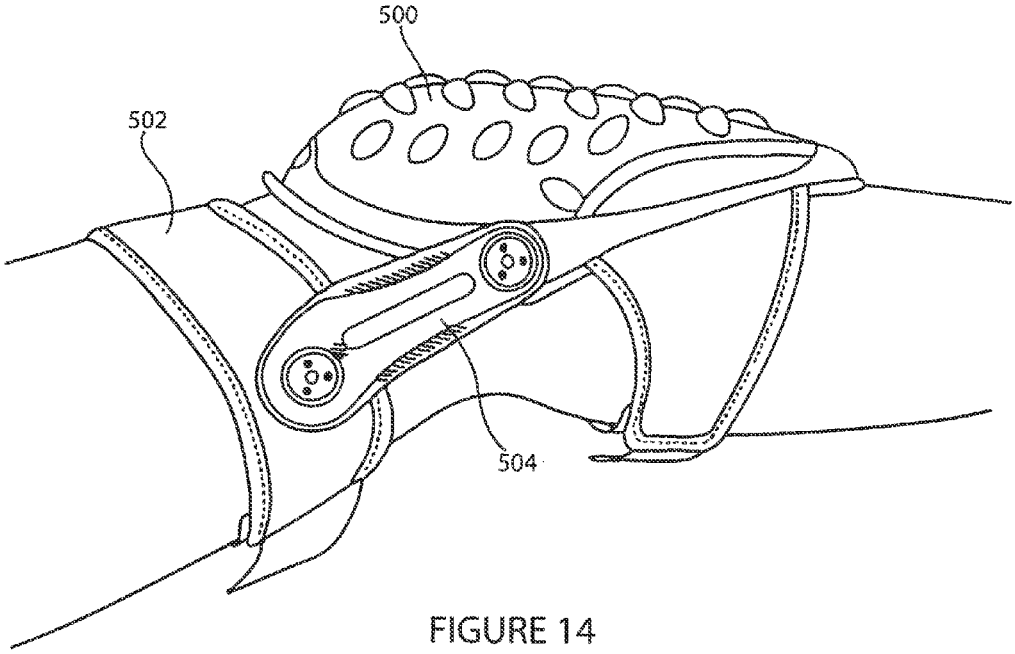
Figure 15:
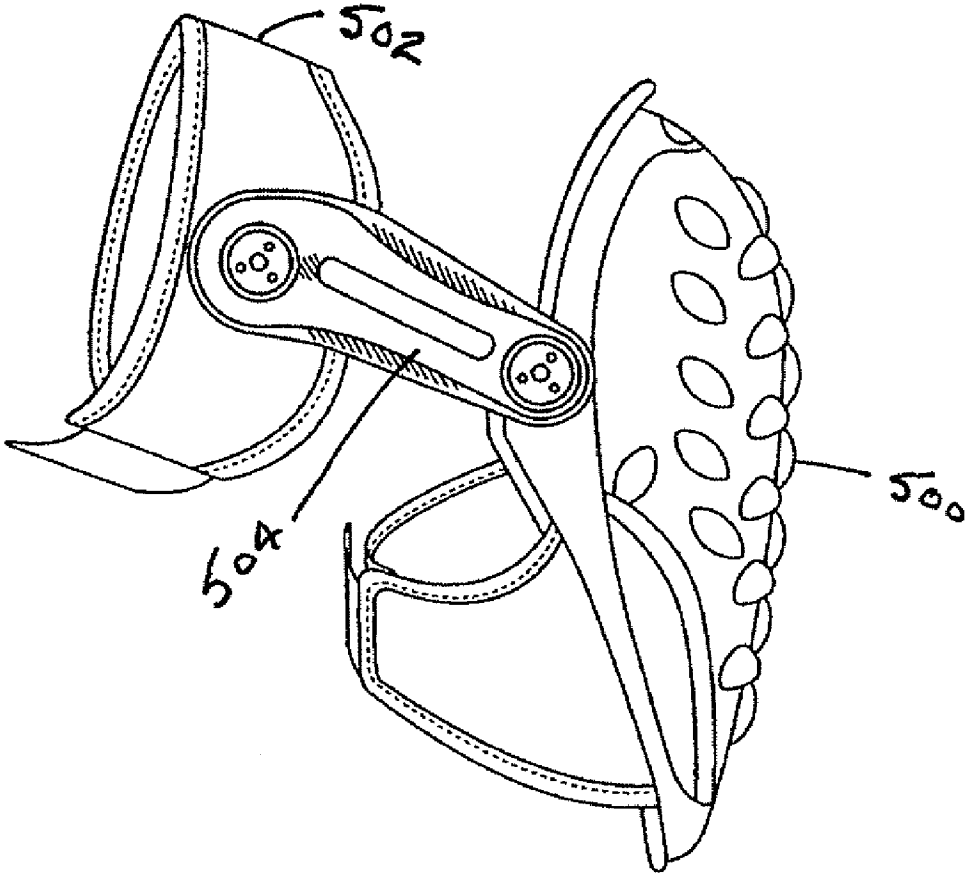
Figure 16:
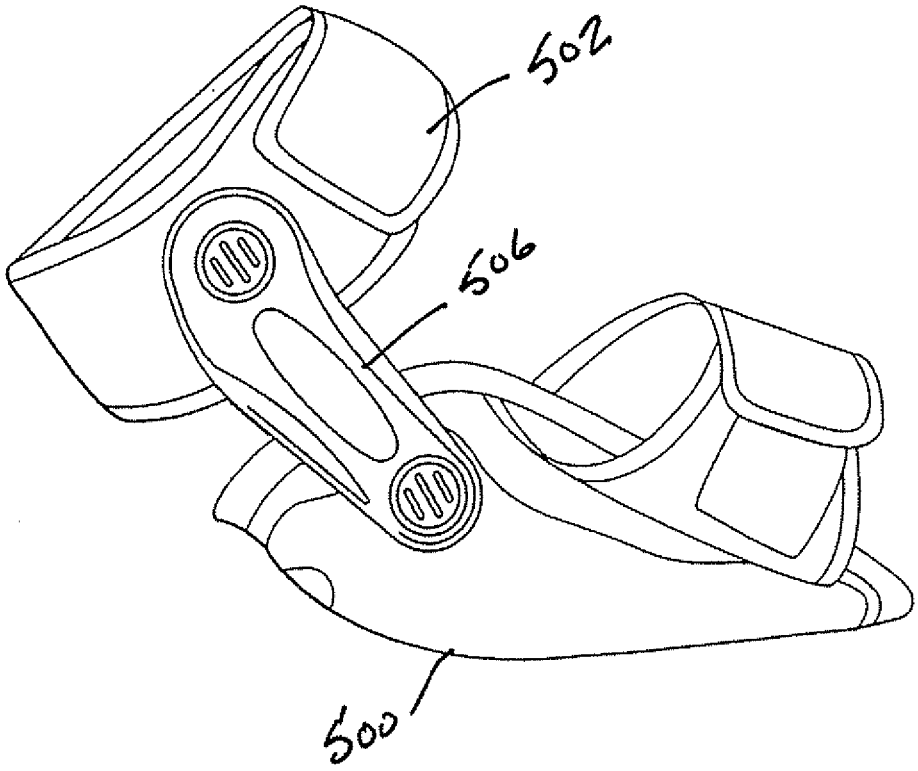
Figure 17:
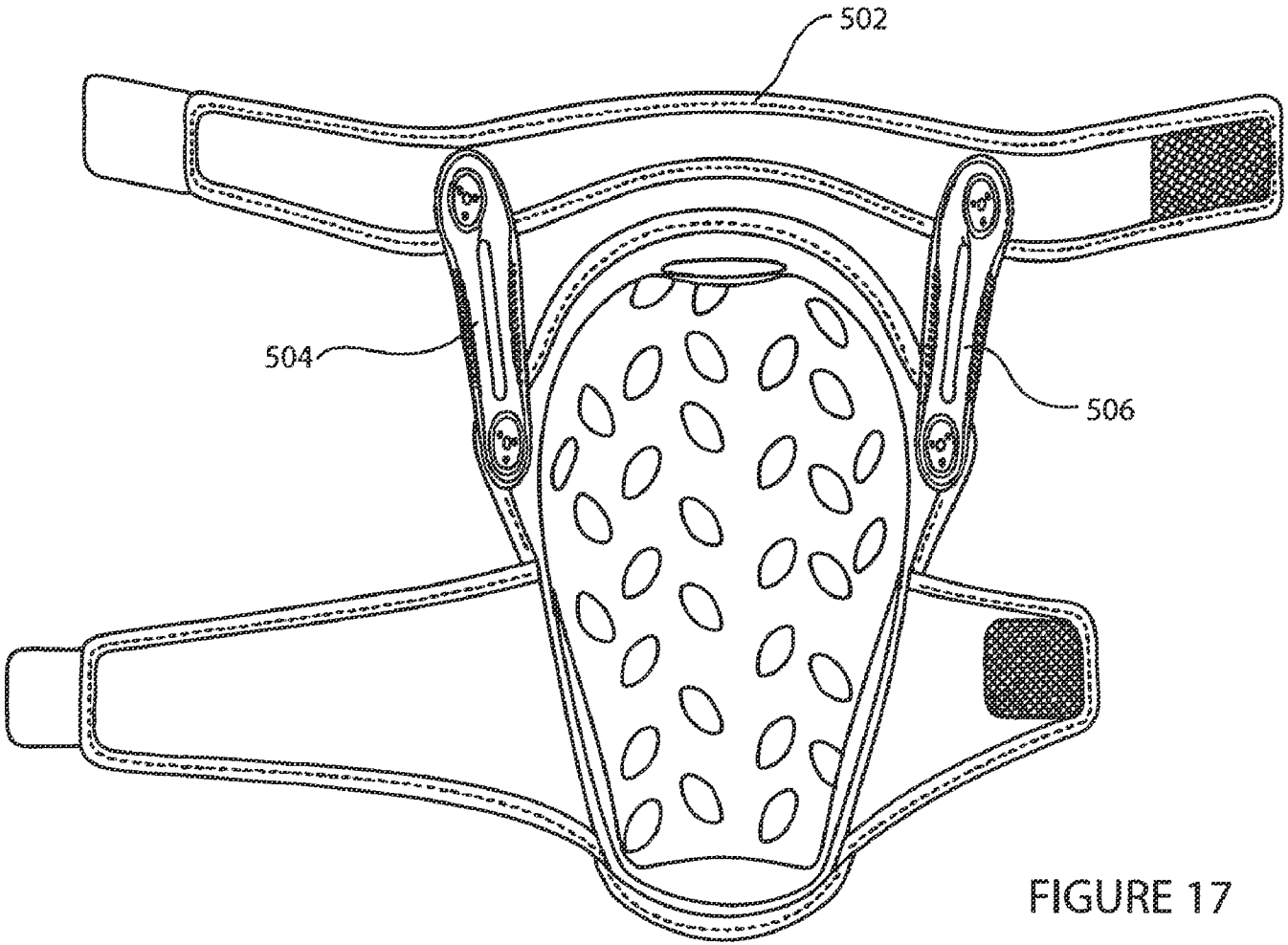

FIGS. 14-20 depict yet another embodiment of the invention. In the embodiment of these figures, an outer hard knee protective shell 500 is connected to a thigh strap 502 by means of links 504 and 506 pivotally attached to the lateral sides of the hard shell 500. The hard shell 500 is attached to a padded member or layer 512 which fits over an internal pocket and gel insert 514. The layer of padding 512 includes a first strap 516 and a second strap 518 which may be joined to connect about the upper end of the lower leg of an individual beneath the knee, for example, as depicted in FIG. 14. The thigh strap 502 includes opposite ends 520 and 522 which may be connected again as depicted in FIG. 14 to hold the shell 500 of the assembly appropriately retained on the knee of an individual.

Figure 19:
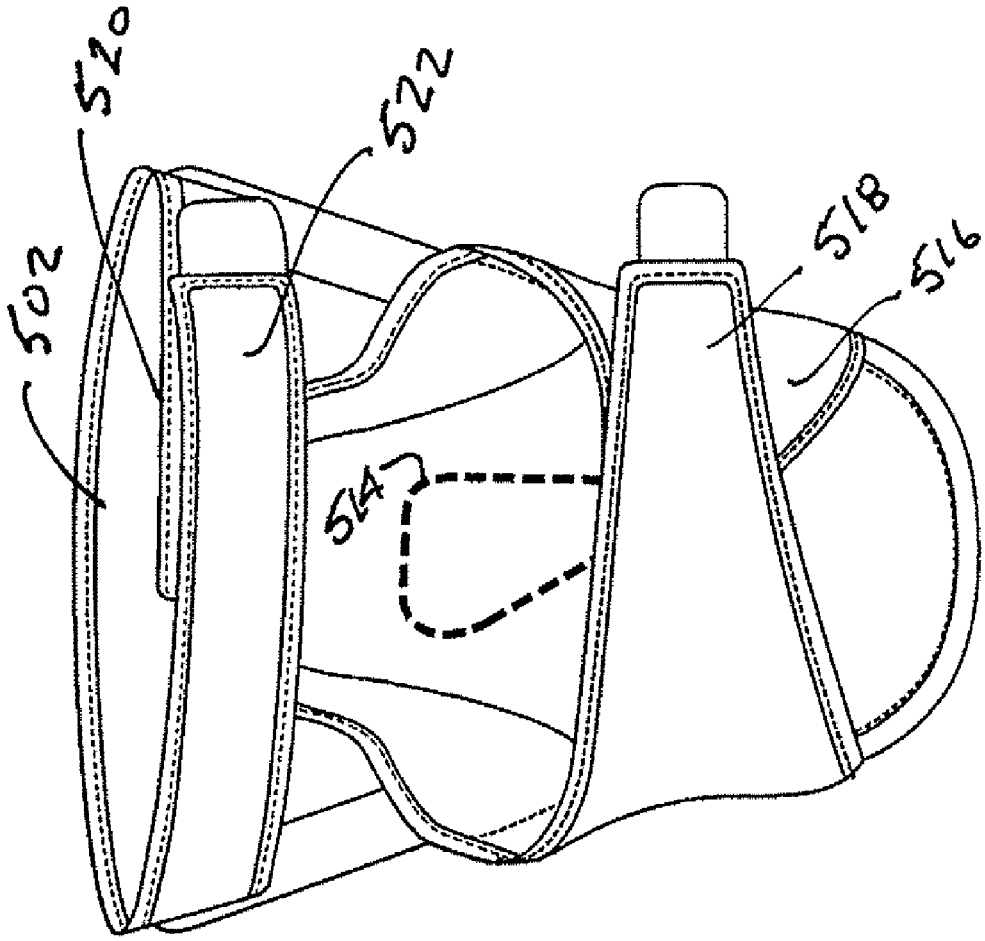
Figure 20:
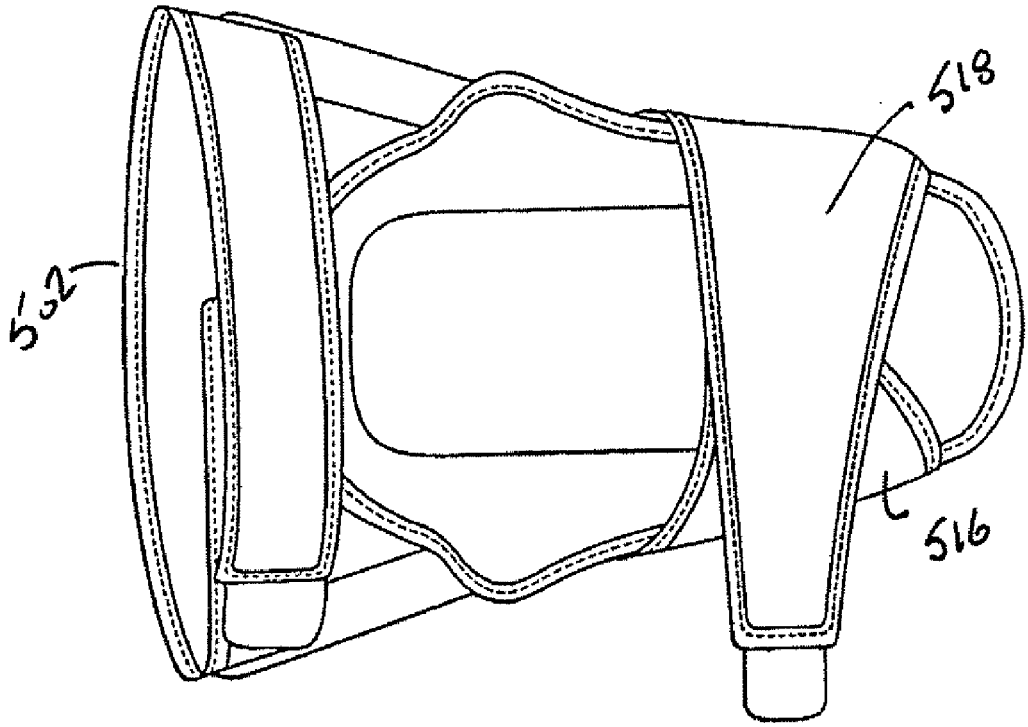
Figure 21:
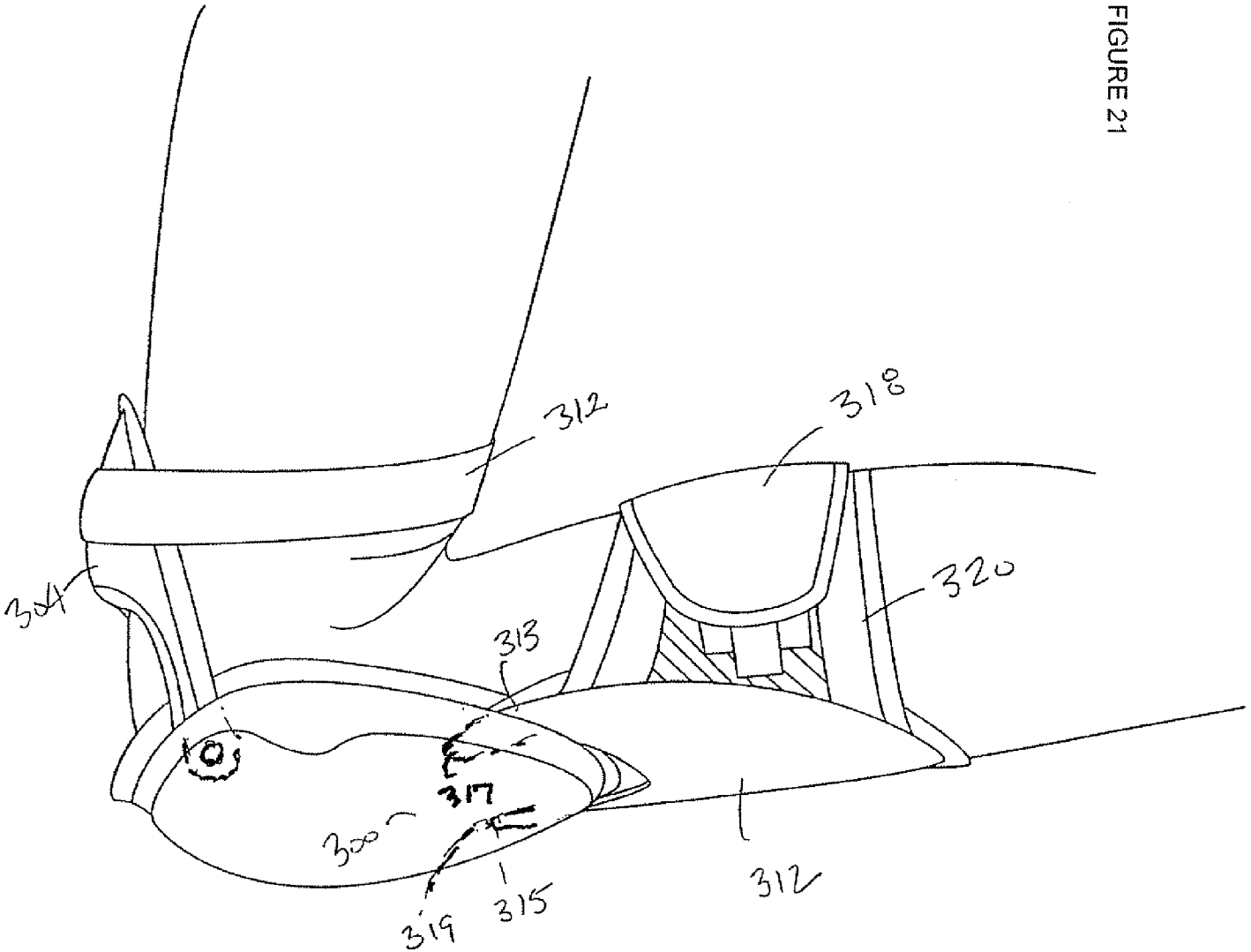
Figure 22:
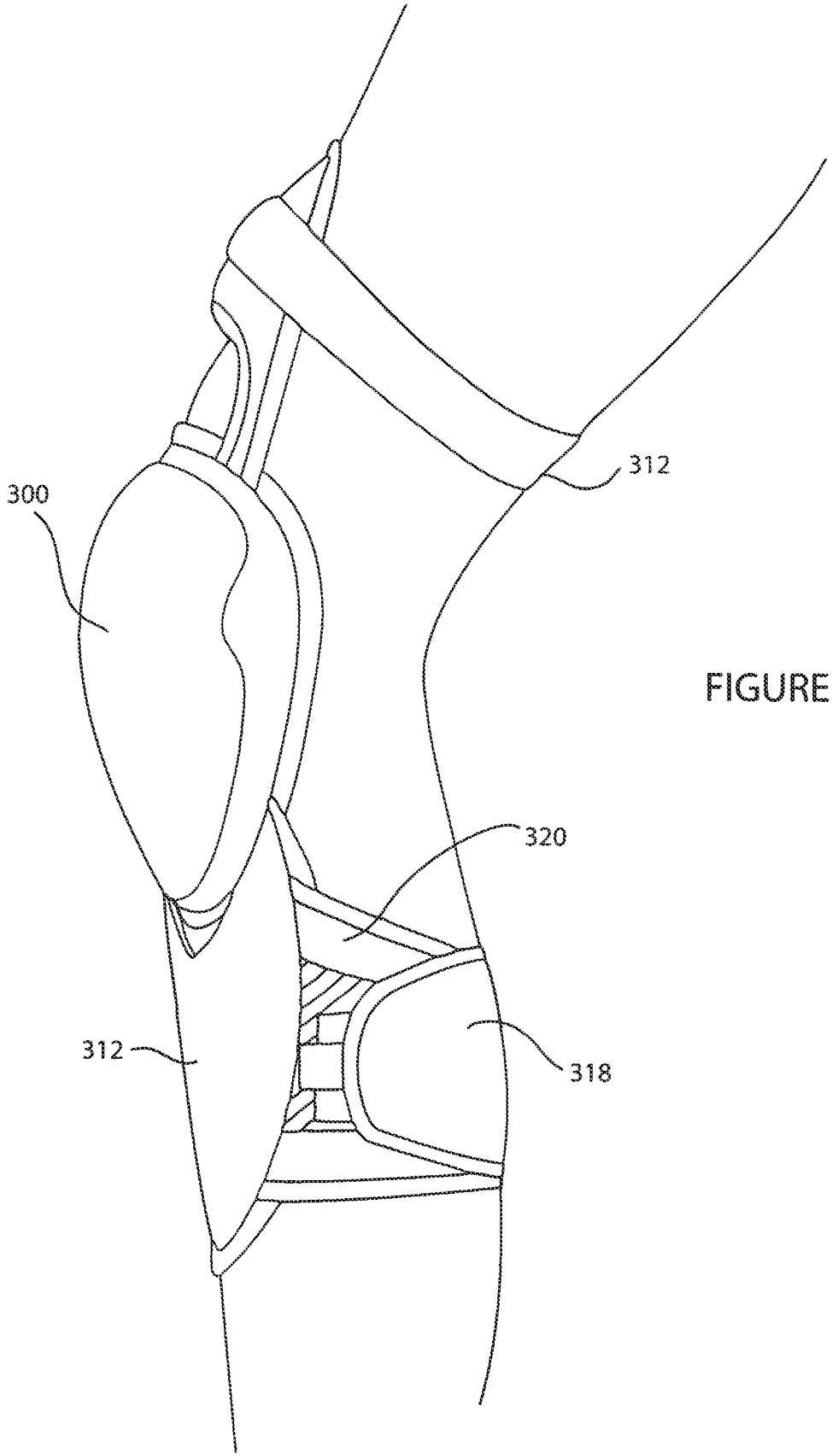
Figure 23:
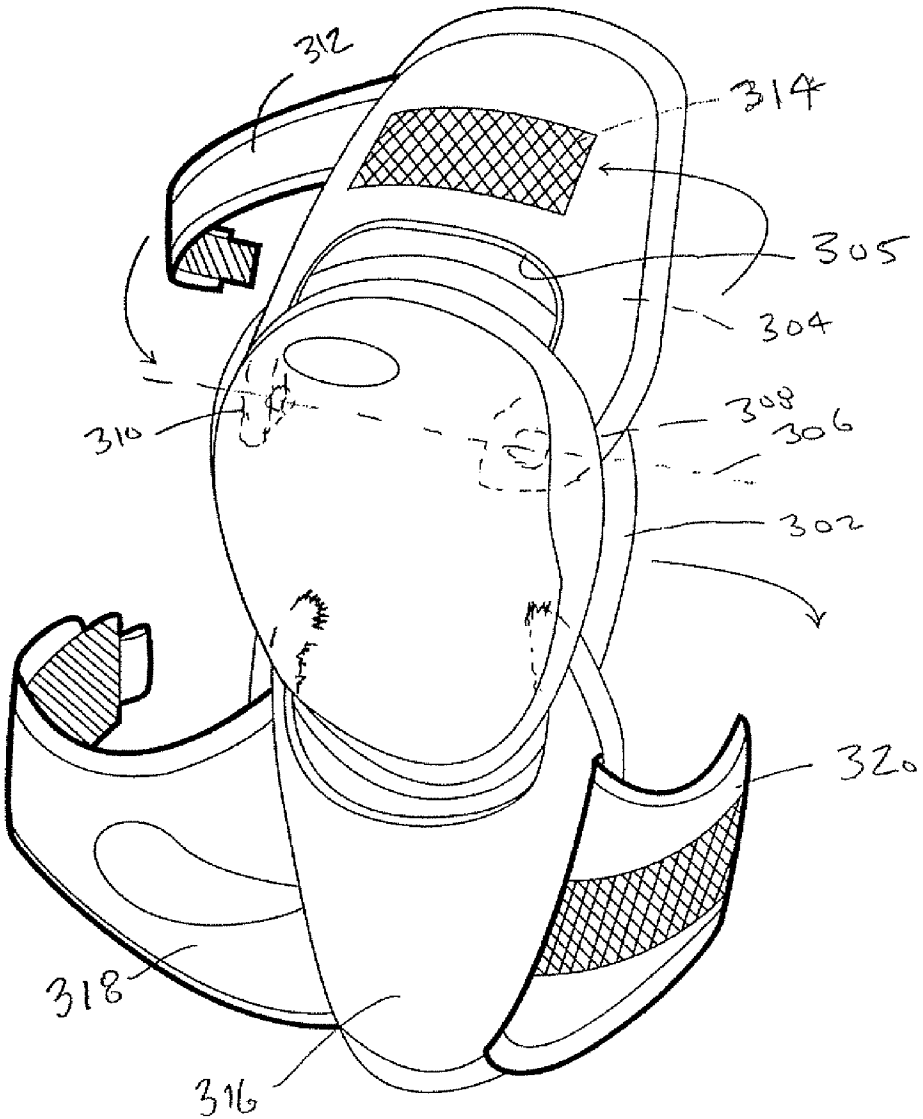
Figure 24:
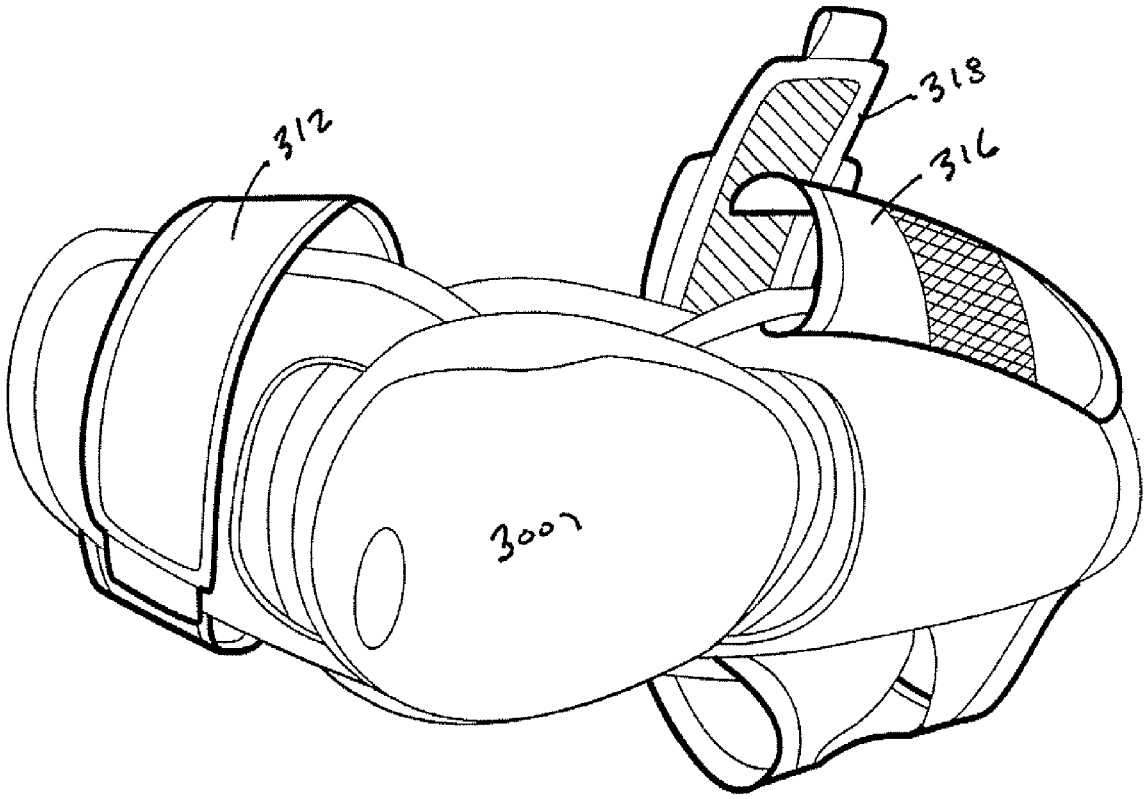
Figure 25:
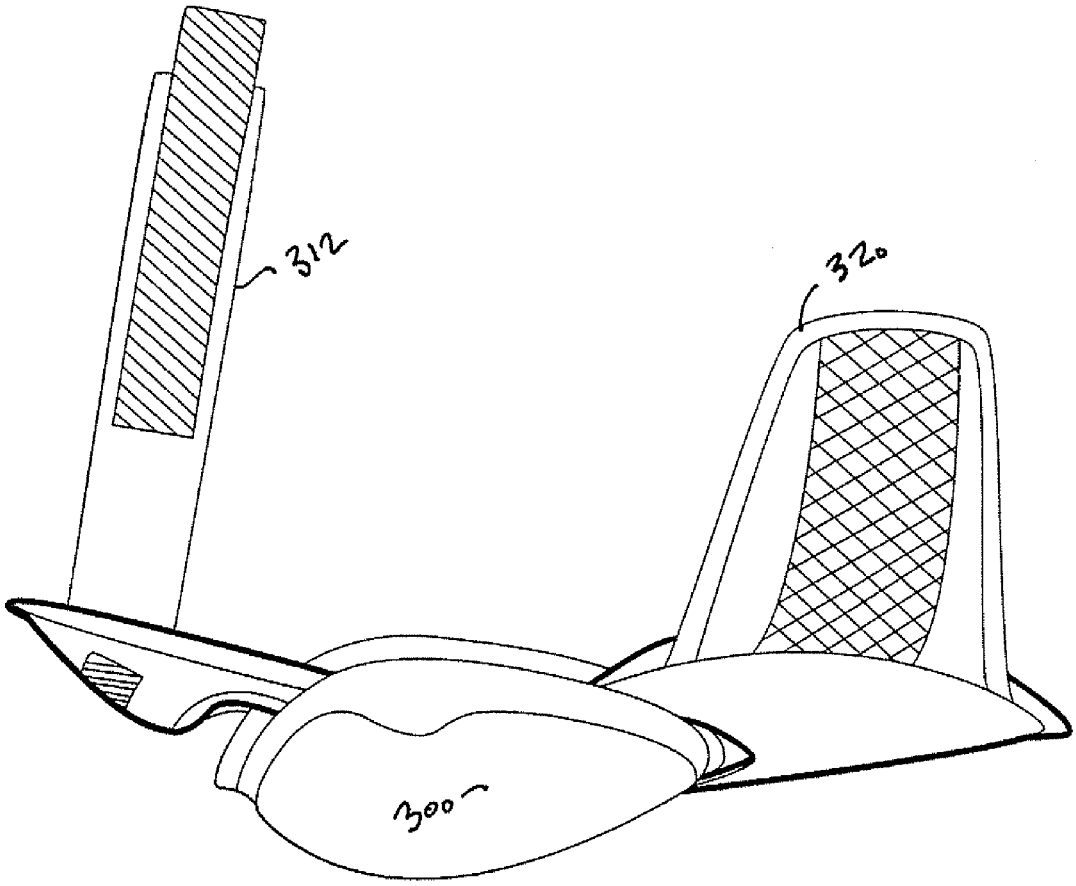
Figure 26:
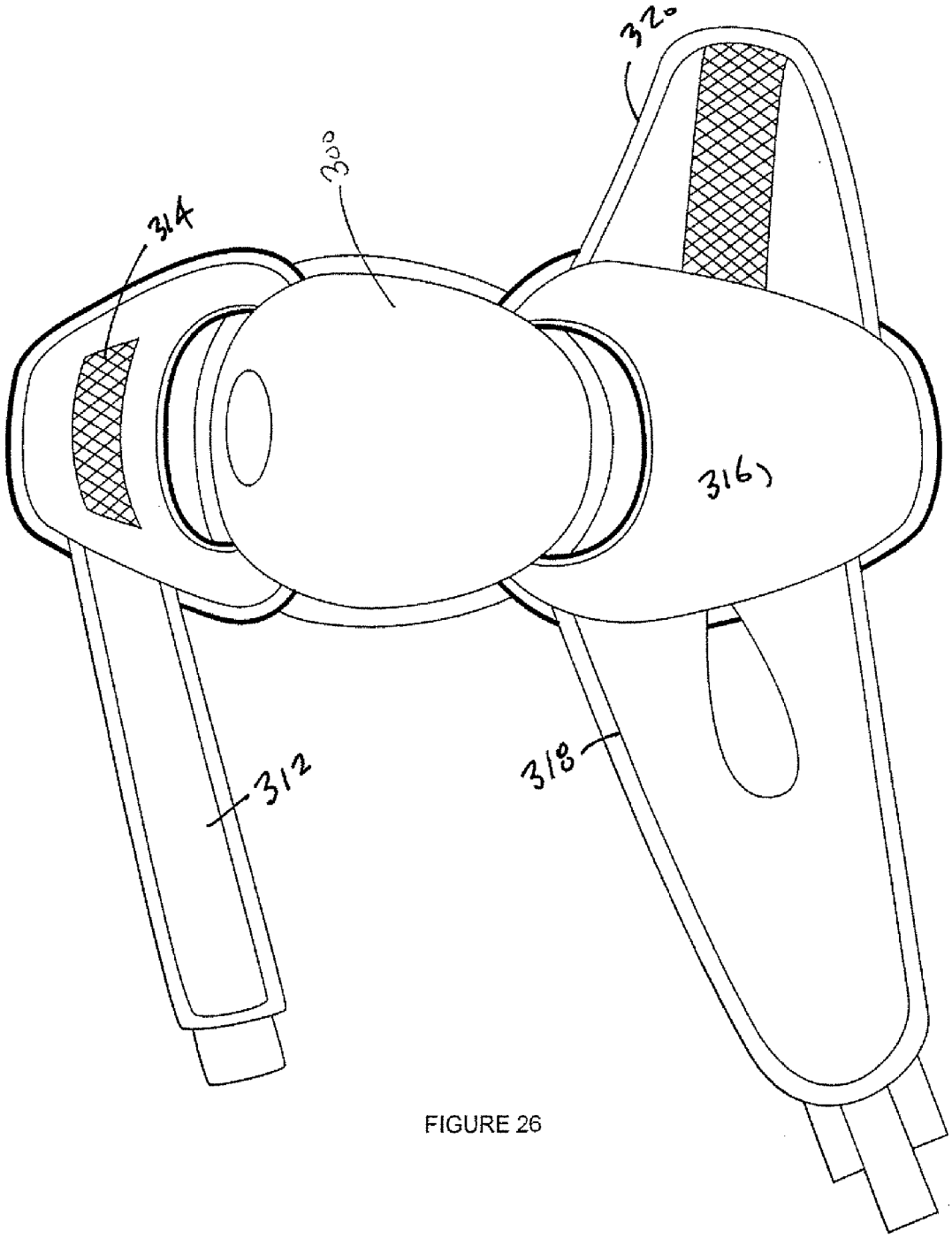

The straps may thus be folded over one another, for example, as depicted in FIGS. 19 and 20 to fit around the back side of the lower leg and lower thigh of an individual to be held thereon. The links 504 and 506 typically connect the thigh strap 502 to the outer rim of the hard shell 500. However, it is possible to have the links joined to the padded material, though that is not necessarily the preferred method of construction. The links 504, 506 are generally rigid links which are pivotally connected at their opposite ends, respectively, to the thigh strap 502 and the shell 500. Again, none of the straps 502, 516 or 518 fit against the back side of the knee in order to enhance comfort. Further, the transverse axis or the axis between the pivot points connected to the hard shell 500 are generally aligned with the knee joint to insure that the knee pad construction will remain affixed appropriately on the leg of an individual. FIG. 20 depicts a slightly modified construction of a knee pad depicted in FIG. 19 wherein the straps 502, 516 and 518 are reversed.

FIGS. 21-26 show a feature which may be incorporated with the embodiment of FIGS. 1-4 or alternatively, with the embodiments of FIGS. 5-20 or other embodiments The feature of FIGS. 21-26 is the inclusion of an upper shin protection pad 312.

In these figures, a hard outer shell 300 is divided and includes an inner padded shell construction 302 affixed thereto, for example, by being stitched thereto. The hard outer shell includes an upper shell construction 304, namely shell 304 is pivotally connected along an axis 306 by pivotally connecting projecting arms 308 and 310 to the combination of the hard outer shell 300 and its associated interior padding 308. By attaching the arms 308 and 310 in the area intermediately hard outer shell 300 and the padding 302, the arms will be protected and will still enable pivoting thereof relative to the shell 300. The upper shell or element 304 includes a strap 312 which may be fitted around the upper thigh of an individual and which may be attached to hook and loop material 314 affixed to the shell 304. In this manner, the shell 304 may be positioned snugly against the leg of the individual and may pivot relative to the hard shell 300, which fits over the knee or patella of an individual. The upper shell 304 includes a cut away section 305 to enable the upper shell 304 to pivot through a desired range of rotation relative to the middle shell 300. The axis of rotation of the upper shell 304 relative to the lower shell 300 is again generally aligned with the pivot axis of the knee of an individual wearing the knee pad construction of this embodiment.

Figure 18:
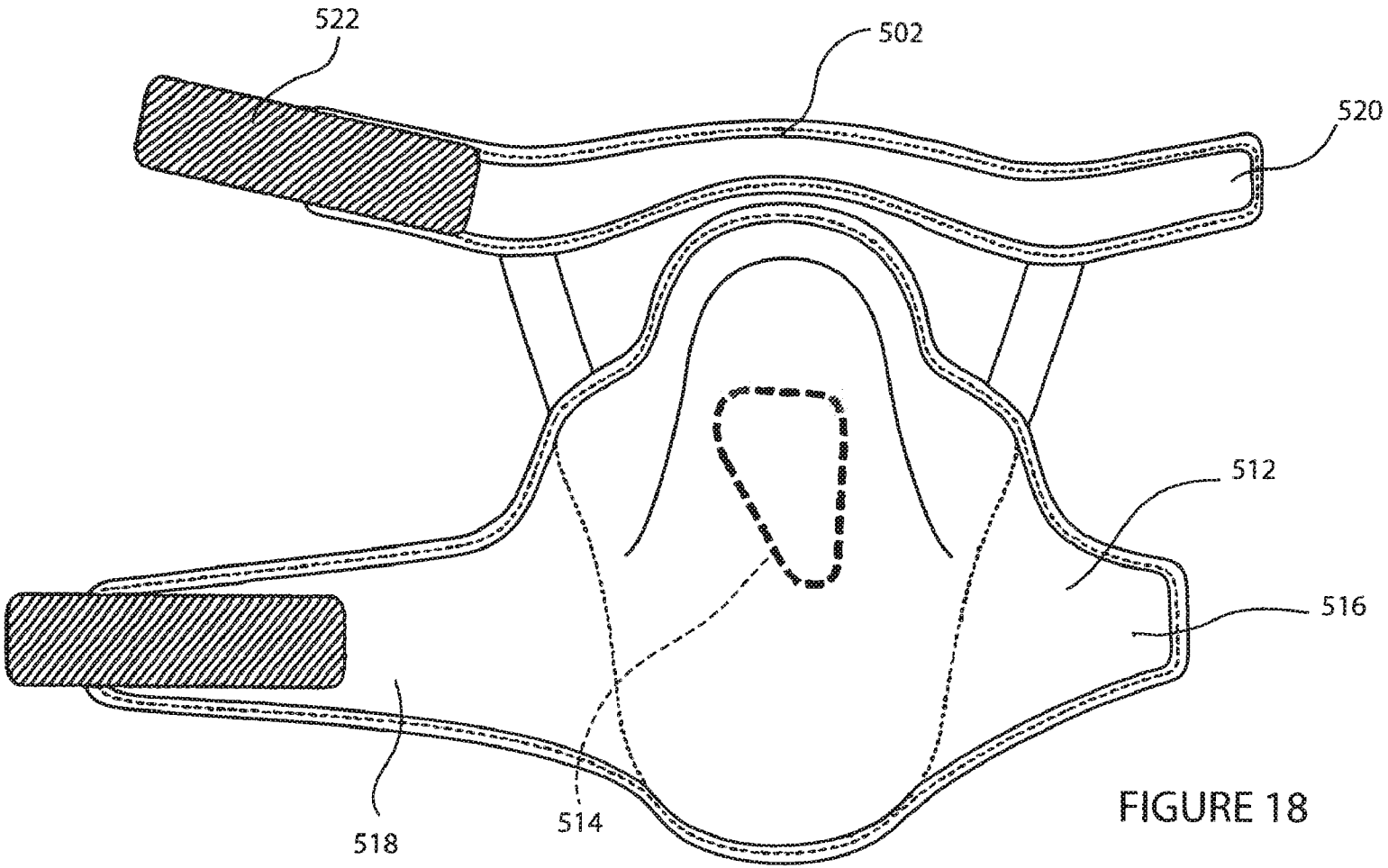

The embodiment also includes a shin protector, namely the shin protector 316 comprised of an outer shell which includes a first lateral strap 318 and a second lateral strap 320 affixed to the side edges thereof. The straps 318 and 320 may be fitted about the back side of the lower leg of an individual, for example, as depicted in FIGS. 18 and 19.

The strap 312 retains the upper hard shell 304 in position on the thigh of an individual and may be pivoted with respect thereto about the middle shell 300. The pivot axis again is depicted as being generally aligned with the axis of rotation of the knee of the individual wearing the assembly. The lower shin guard 316 is attached by means of the straps 318 and 320. It will be noted that the straps 318 and 320 fit generally around the upper calf of an individual. In this manner, the hard middle shell 300 is retained in position over the kneecap or patella of an individual.

The lower shin element 312 includes a first arm 313 and a second arm 315 which are generally mirror images of one another and which are stitched at their upper ends 317 and 319, respectively, to the upper shell 300. Thus, there is some possibility of flexure of the shin guard 312 with respect to the knee guard 300. However, a full pivotal relationship is not necessary. The flexure permitted by the stitched connection is generally adequate.

The knee pad or knee cover 300 is held in position by strap arrangements associated respectively with the upper thigh shell configuration 304 and the lower shin guard 312. This ensures that there is no strap immediately behind the knee which could possibly pinch an individual or otherwise be uncomfortable.

Figure 27:
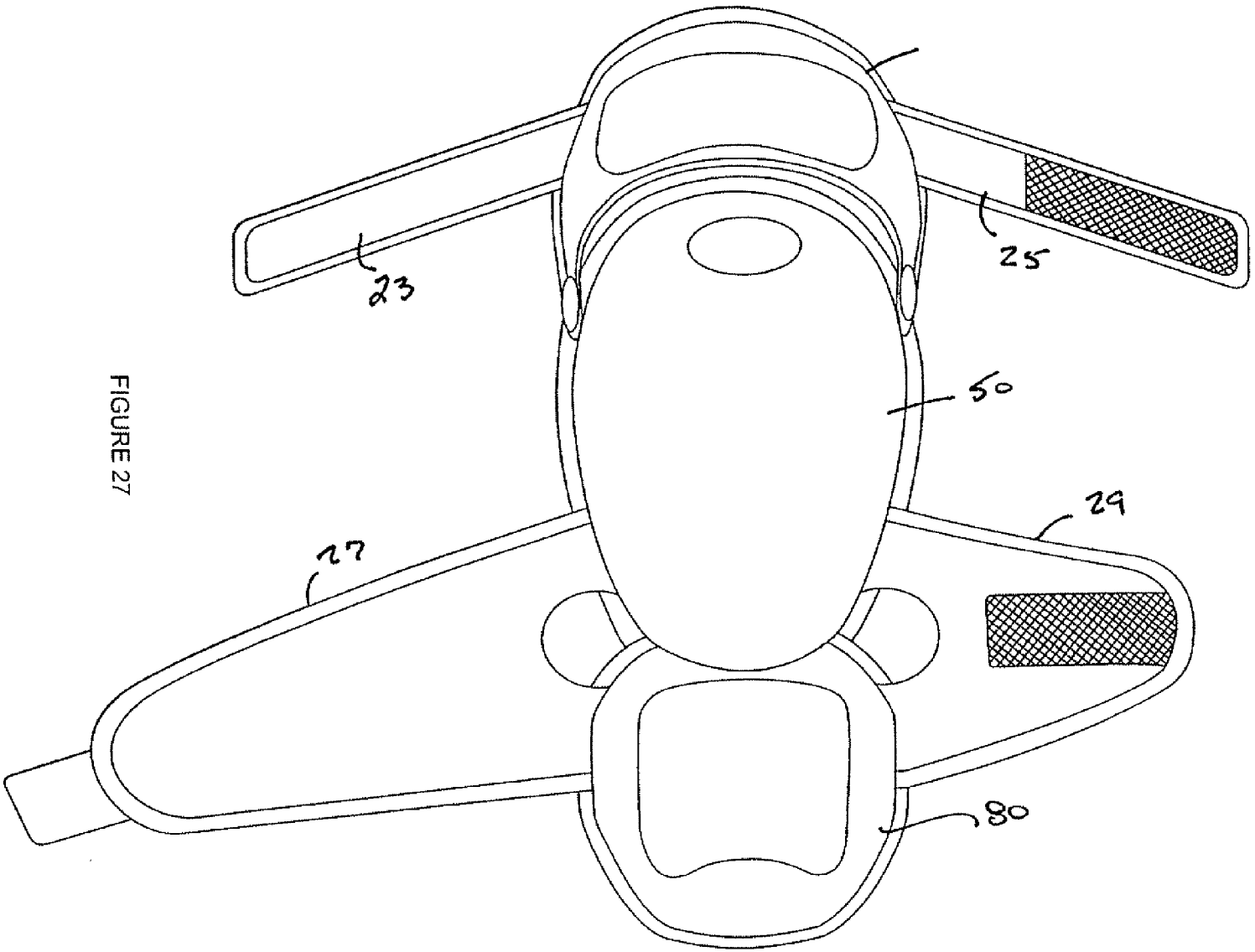
FIG. 27 is a front plan view of an alternative version of the knee pad of the embodiment of FIGS. 21-26.
Figure 28:
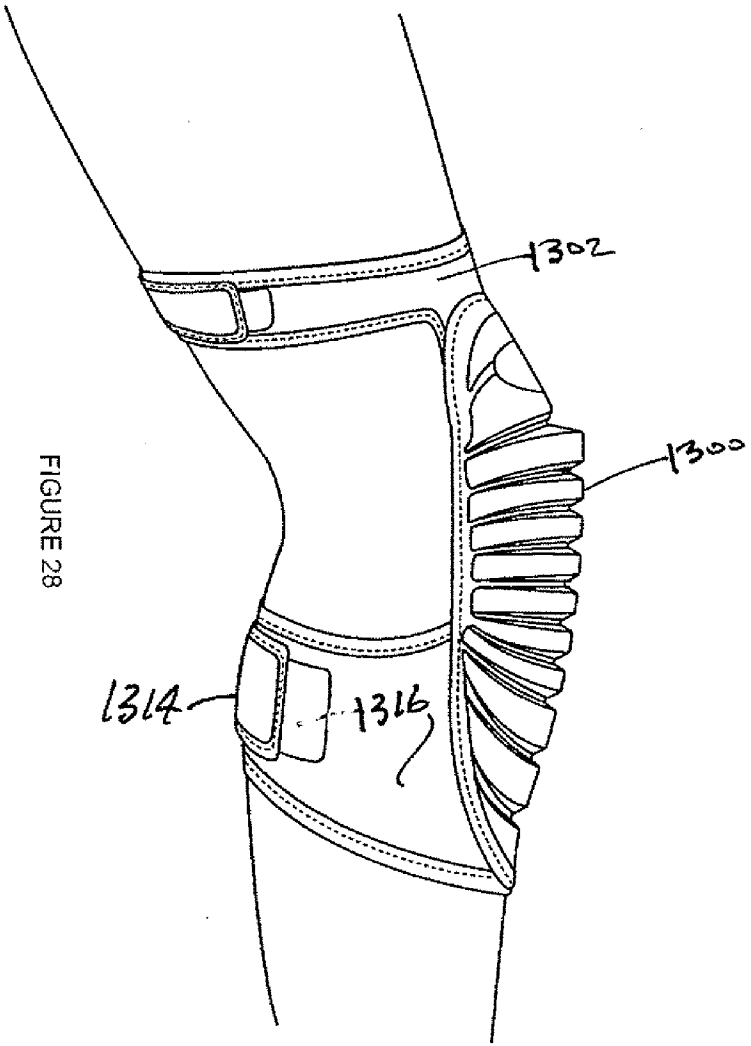
Figure 29:
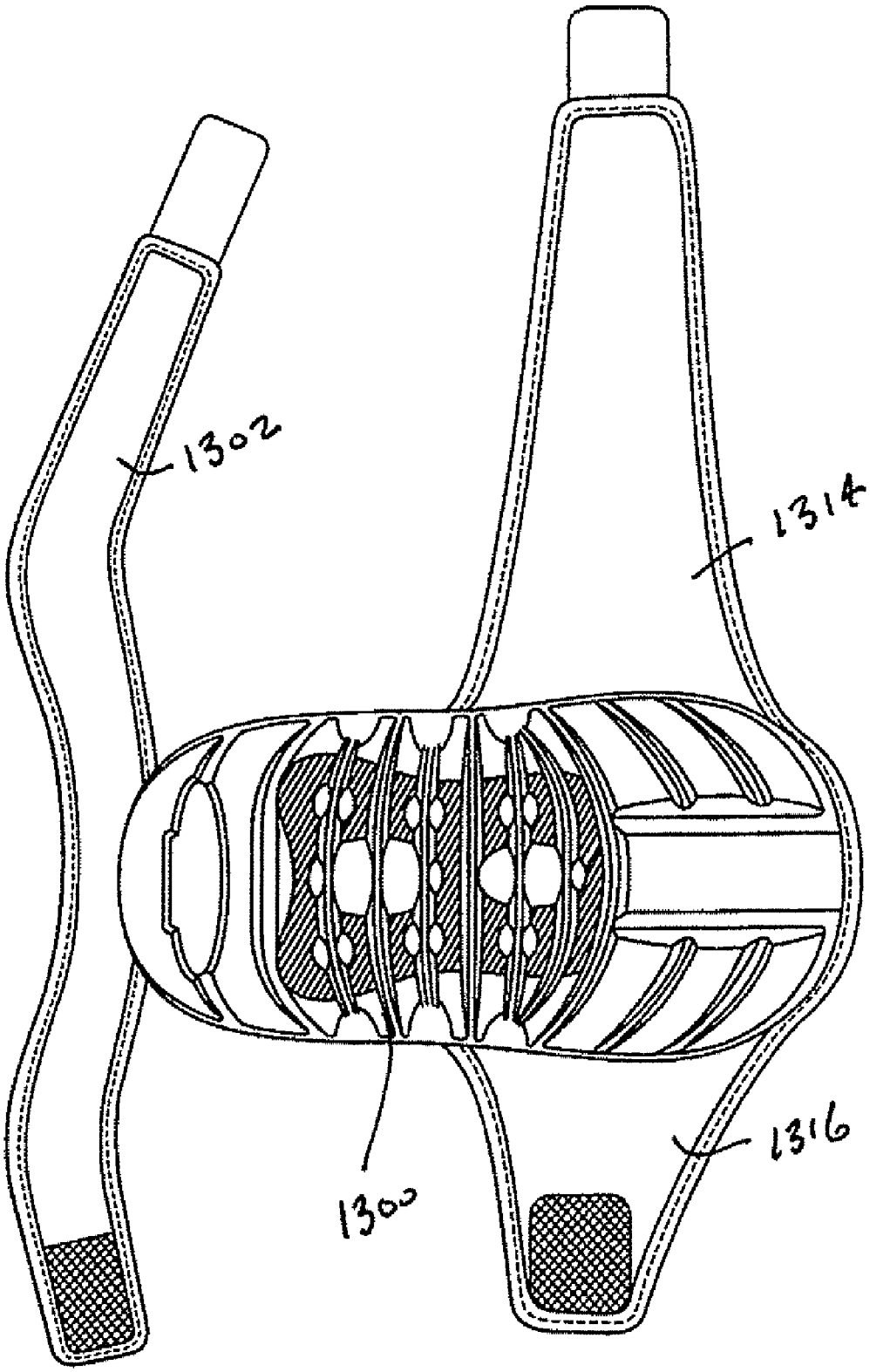

FIG. 27 depicts an alternative strap arrangement to the construction of the embodiment of FIGS. 21-26. In particular, the construction of the knee pad is substantially identical except that in FIG. 27 the embodiment includes straps 23 and 25 associated with the thigh attachment section or member that are extended relative to those in FIGS. 21-26. In a similar manner the strap construction comprising the straps 27 and 29 associated with the knee pad or shell 50 are extended in opposite directions so as to provide a means for connection thereof. Further, the straps 27 and 29 are bifurcated and include portions thereof attached respectively to the knee shell section 50 as well as the upper shin section 80. In this manner, the knee pad provides a means for appropriately holding the various component elements thereof in a very rigid, yet comfortable fixed position on die knee of an individual.

Figure 30:
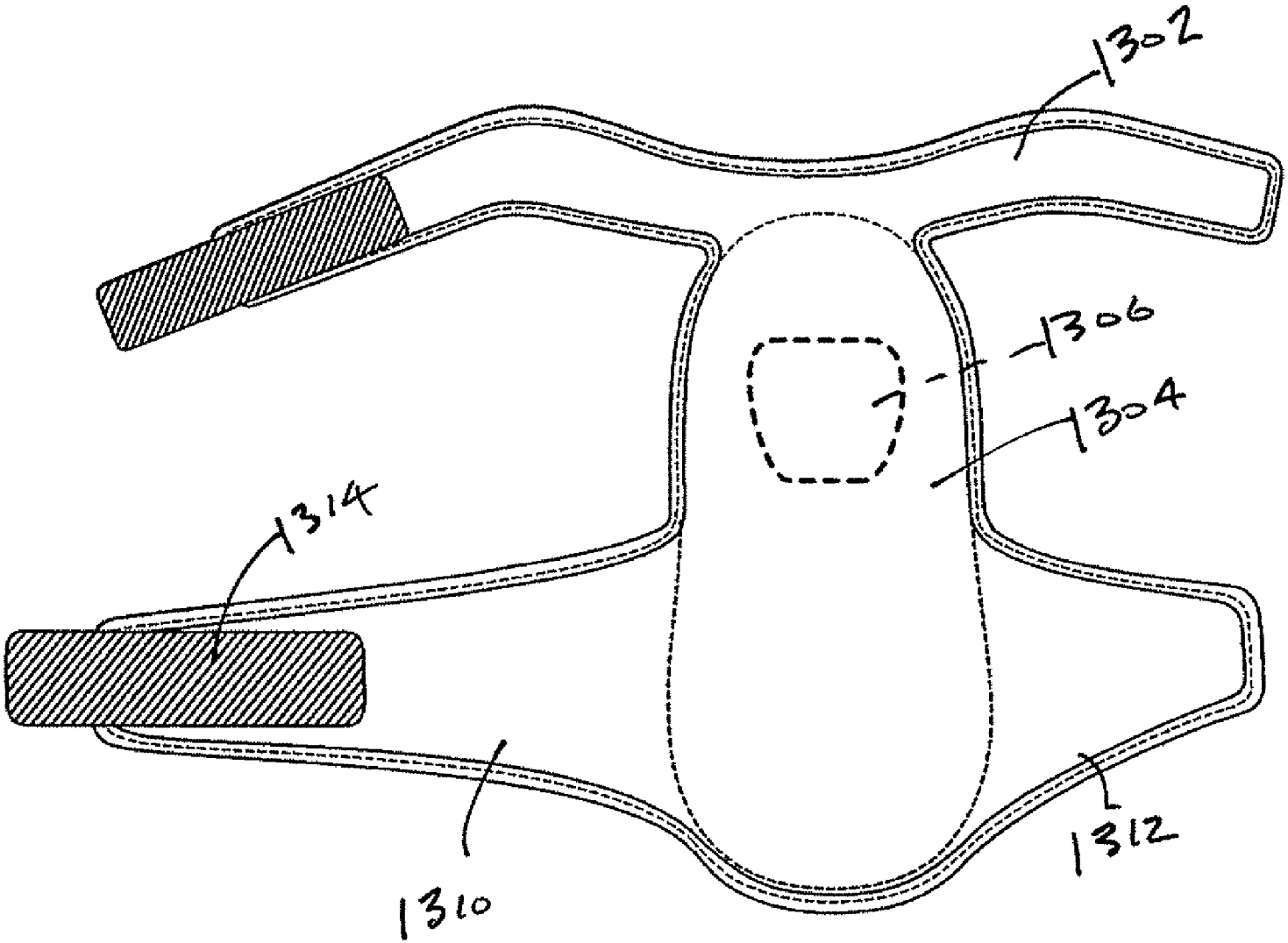
Figure 31:
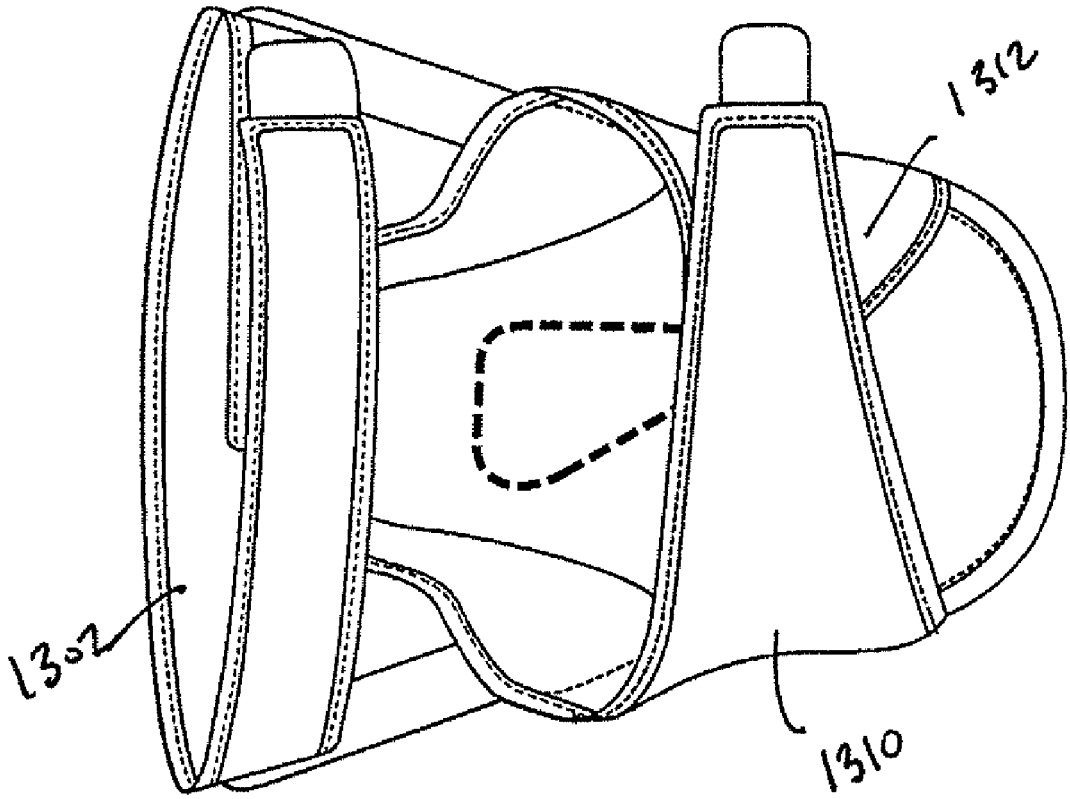

FIGS. 28-34 illustrate yet a further embodiment of the invention. Referring to these figures, a knee pad assembly is comprised of a hard outer shell 300. An upper thigh strap 302 is incorporated with and forms a part of a fabric padded layer of material 304 such as depicted in FIG. 30. The padded material 304 fits against the inside concave surface of the hard shell 300. The inside concave surface of the hard shell may include a recess and a gel insert 306. The padded portion 304 including the upper thigh strap 302 is shaped to fit above the knee joint. The padded section 304 further includes a set of lower straps 310 and 312 which are designed to fit below the knee as depicted, for example, in FIG. 28. The straps 310 and 312 include, for example, hook and loop fastening material 314 and 316 which enable the strap to be tightly or snugly placed around the upper, lower leg of an individual beneath the knee joint. It is to be noted that the straps 302, 312 and 314 do not fit behind the knee joint of an individual. Thus, the hard shell and the cushioning associated therewith are positioned in a manner that will enable a person to bend their knee comfortably without being made uncomfortable.

Figure 32:
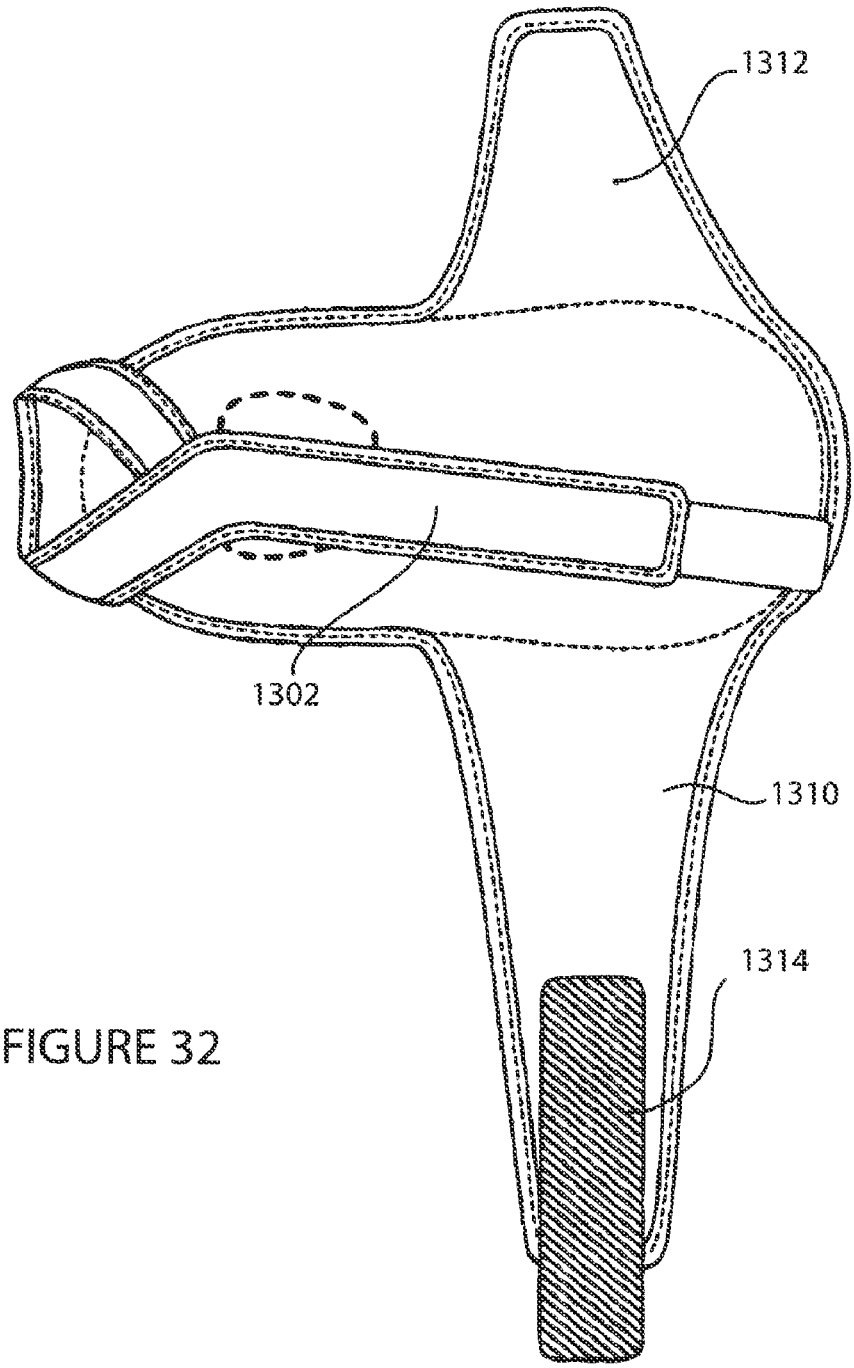
Figure 33:
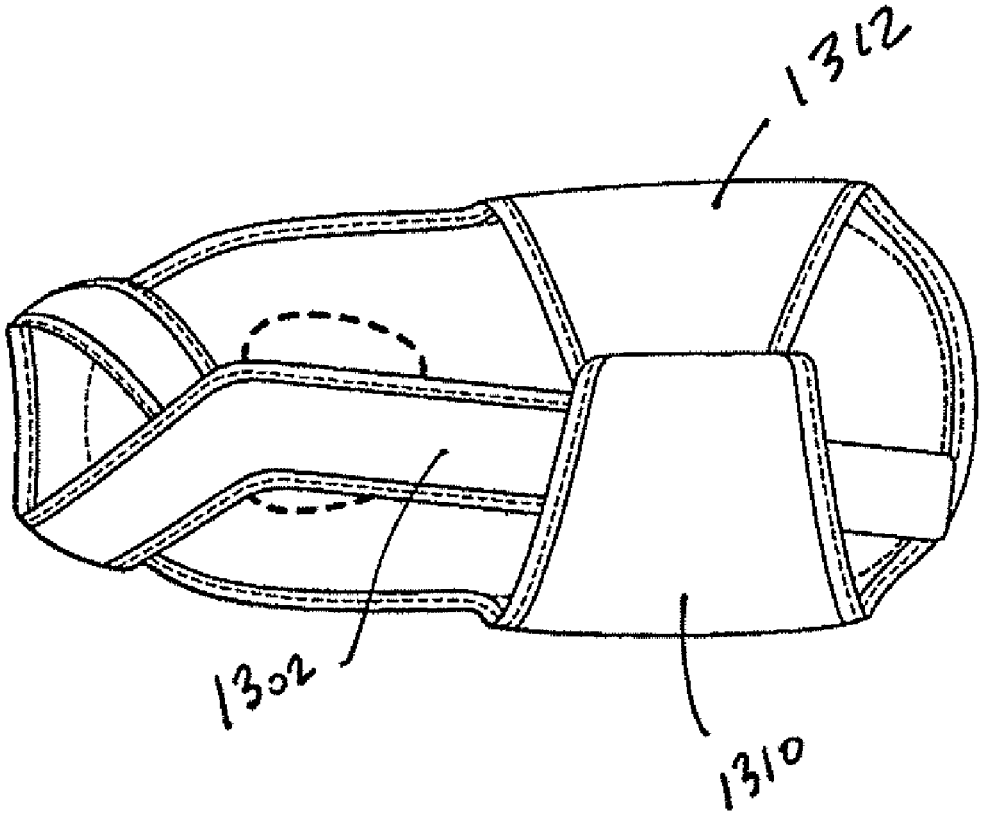
Figure 34:
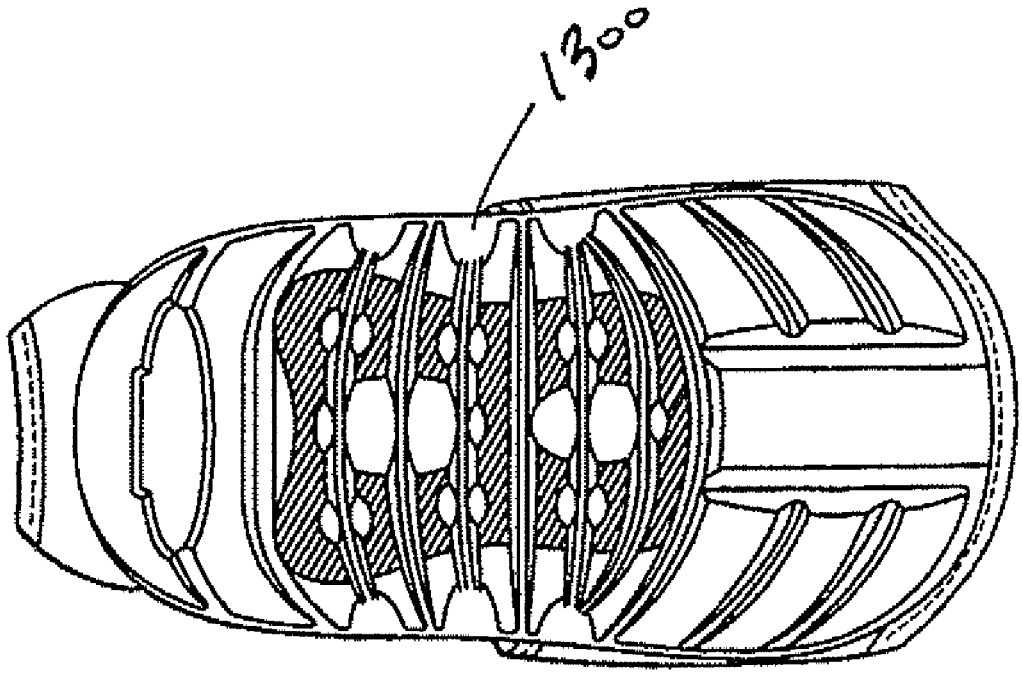

A feature of the construction of FIGS. 28-34 is illustrated in greater detail in FIGS. 32-34. That is, for purposes of packaging, for purposes of display and for purposes of storage, the thigh strap 302 may be folded in the back side pocket or concave region formed by the padding 304. The lower strap 314 and 316 may then be folded over that thigh strap 302 to provide a compact assembly which will fit within a storage box or otherwise be easily stored, for example, once the knee pad construction is opened, but may be folded to place it in a storage facility. Thus, the hard shell 300, as depicted in FIG. 34, will, in essence, serve as a housing for the straps during packaging or when otherwise being stored. This feature can be incorporated in each of the embodiments heretofore discussed and disclosed.

Figure 35:
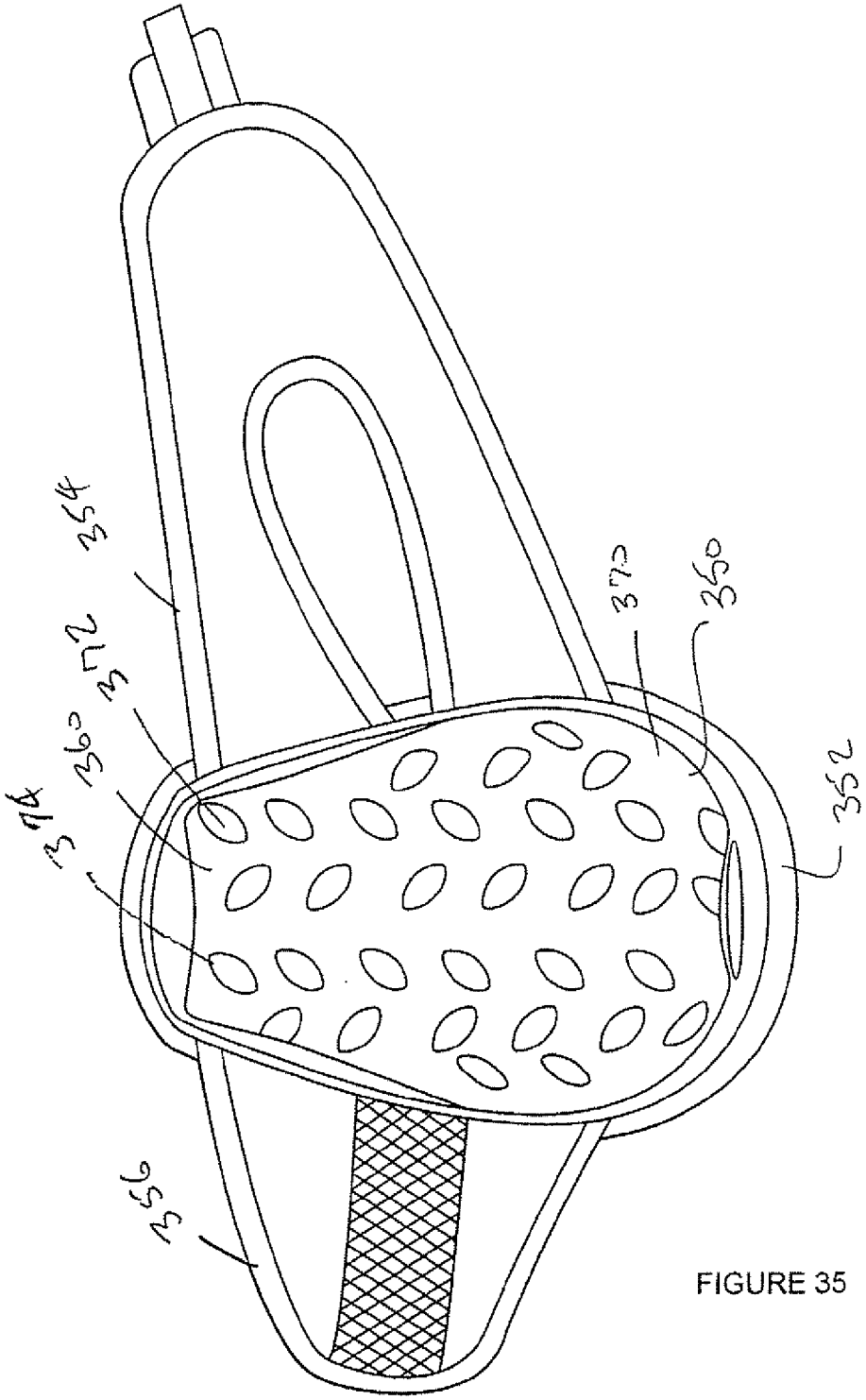
Figure 36:
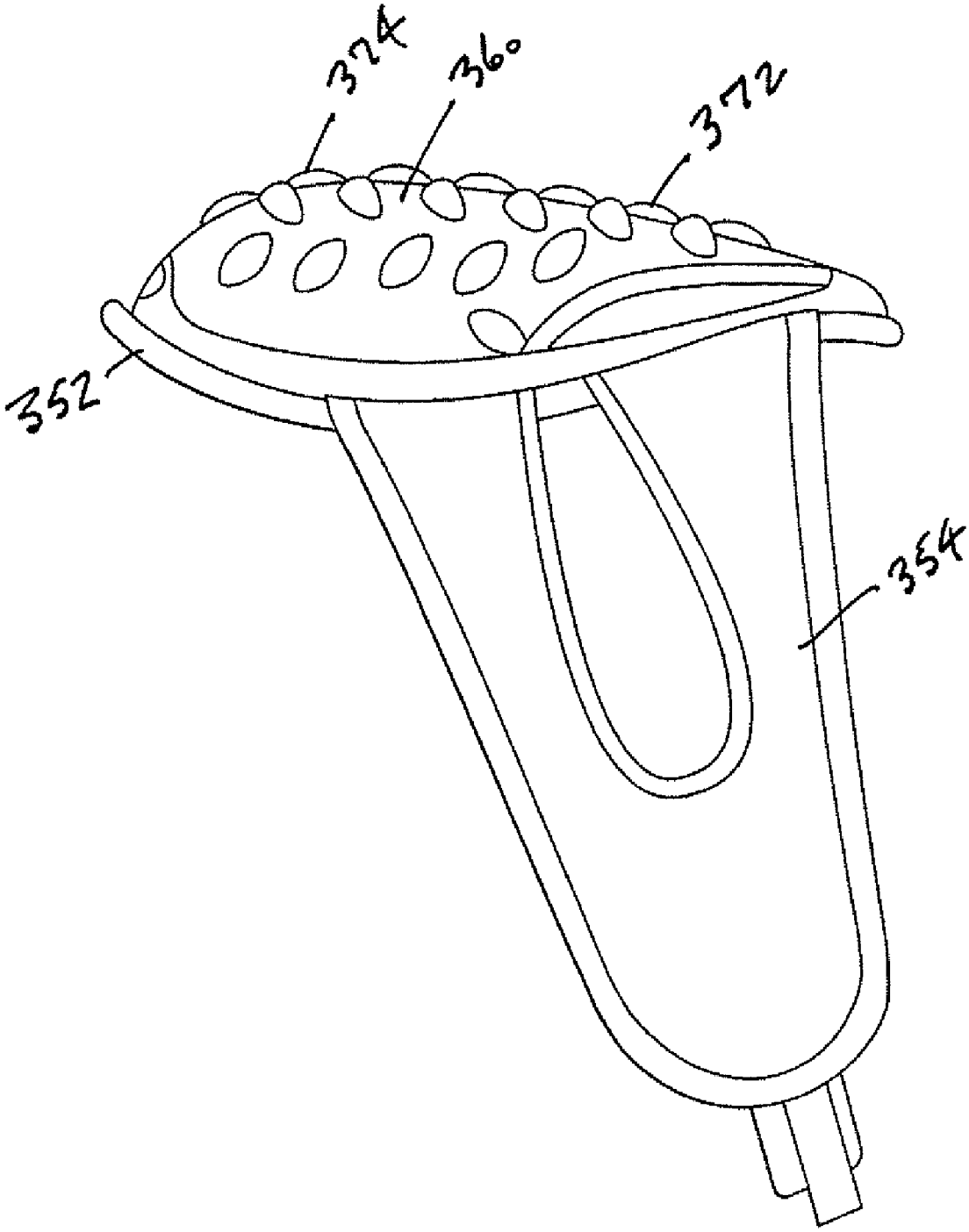
Figure 37:
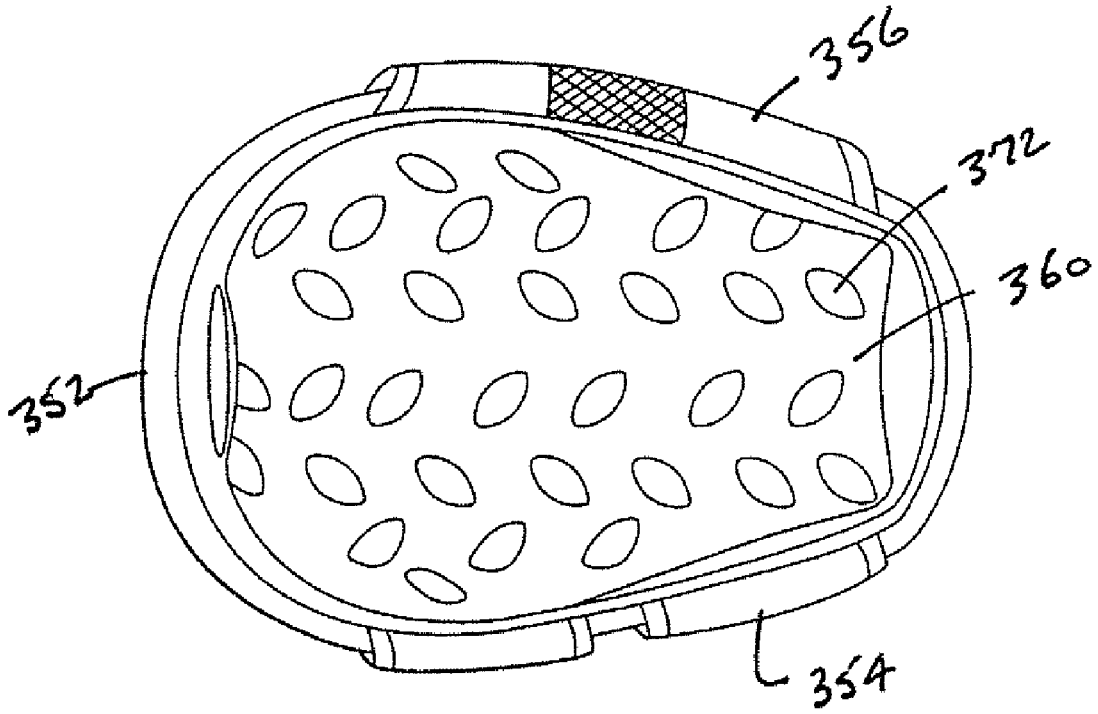

FIGS. 35-37 illustrate a further feature that is incorporated into embodiments of the invention. Referring to those figures, the figures depict a pad cover 350. The knee pad cover 350 is formed from a composite material which is considered to be generally hard or extremely hard, and thus extremely protective, such as Kevlar. The outer shell 350 then is combined with an inner shell 352 of padding material, a first lateral strap 354 and a second lateral strap 356. The outer shell 350 is generally pear shaped with the wide portion 360 of the shell positioned at the top side of a knee and the narrow or lower portion 370 of the shell 350 positioned along the underside of the knee. The shell 350 then is cup shaped to fit over the knee and provide protection, especially in the kneeling position during which the knee can fit within the shell. The shell is generally convexly shaped and includes beaded projections such as projections 372, 374 and the like. The beaded projections 372 and 374 and the like are arrayed over the face of the shell so that regardless of the position of the knee, even though the shell is generally convex in shape, the beaded projections will engage against surface and cause the shell surface primarily to be raised or spaced from the surface on which a worker using the knee pad is placing his knees. Thus, if the surface is tacky or otherwise provides the option of sticking to the knee pad, the utilization of the projections 372, 374 and the like will prevent a permanent adherence.

Any of the described embodiments may include a soft peripheral material rub surrounding the margin or edge of the hard shell. Thus, when the person using the knee pad moves, the hard outer shell will not cut or bind in the leg of the user.

While there have been set forth various embodiments of the inventions along with a detailed description thereof, the invention is limited only by the following claims and equivalents thereof.

What is claimed is:

1. A protective knee pad for workmen comprising, in combination:

a first generally rigid formed shell, said shell including a concave interior, a pad assembly on the concave interior, an upper section of said pad assembly and shell configured to fit above the knee joint, a middle section of said pad assembly and shell configured to fit over the patella, and a lower section of said shell and pad assembly projecting downwardly configured to fit over the upper shin such that when worn, the first shell and pad assembly completely covers the wearer's patella;

a second generally lower thigh attachment member configured to fit around the lower thigh and above the first shell and pad assembly;

a first lateral side link flexibly attached at one end to a first lateral side of the first shell and attached at its opposite end to a lateral side of said thigh attachment member; and a second lateral side link flexibly attached at one end to a second lateral side of the first shell and attached at its opposite end to a lateral side of said thigh attachment member, said first and second links being locatable on generally opposite sides of a knee; and a first pivot connection, between the first lateral side link one end and the first shell first lateral side, and a second pivot connection between the second lateral side link one end and the first shell second lateral side with the first and second pivot connections being lateral aligned across the first shell from each other so that the first shell middle section is disposed to extend laterally therebetween in covering relation to the wearer's patella.

2. The knee pad of claim 1 wherein the lower section of the first shell is formed with a generally interior cylindrical configuration and an outwardly curved outmost lower end section.

3. The knee pad of claim 1 further including a cushion rib extending around the outer periphery of the middle and upper sections of said shell, said rib formed from a frictional material for holding the shell in position on a knee with minimal slippage.

4. The knee pad of claim 1 wherein the first and second side links are each pivotably attached to said thigh attachment member.

5. The knee pad of claim 1 wherein said lower thigh attachment member comprises a flexible strap having a left hand strap section, a right hand strap section, and an intermediate strap section connecting the left hand strap section and the right hand strap section, said intermediate strap section curved upwardly over the formed shell whereby when the knee pad shell and thigh attachment member are attached to the leg of an individual, the flexible strap remains upwardly disposed over the shell and attached pad assembly.

6. The knee pad of claim 5 wherein the left hand strap section and right hand strap section are generally straight strap sections respectively joined to the intermediate strap section at a left hand juncture and a right hand juncture, respectively.

7. The knee pad of claim 6 wherein the first side link is joined to the flexible strap at said left hand juncture and said second side link is joined to said right hand juncture.

8. The knee pad of claim 5 wherein the first link is positioned on the left hand side of said shell and said second link is positioned on the right hand side of said shell.

9. The knee pad of claim 6 wherein the first link is positioned on the left hand side of said shell and the second link is positioned on the right hand side of said shell.

10. The knee pad of claim 1 wherein the pad assembly comprises a left hand margin and a right hand margin, and said first side link joins the left hand margin to the thigh assembly member and the second link member joins the right hand margin to the thigh assembly.

11. The knee pad of claim 6 wherein the pad assembly comprises a left hand margin and a right hand margin, and said first side link joins the left hand margin to the left hand juncture and the second side link joins the right hand margin to the right hand juncture.

12. The knee pad of claim 1 wherein said shell and pad assembly include a gel insert in the middle section.

13. The knee pad of claim 1 wherein said pad assembly further includes an attachment strap joining the opposite lateral sides of the middle section of the pad assembly.

14. The knee pad of claim 5 wherein said pad assembly further includes an attachment strap generally positioned for joining the opposite lateral sides of the middle section of the pad assembly.

15. A protective knee pad comprising, in combination:

a first outer shell including a concave interior, first and second opposite lateral sides, a longitudinal axis, a curved top side configured to fit above the knee joint, a middle section configured to fit over the patella, and a lower end section configured to fit over the shin;

a pad assembly of cushioning material affixed to the outer shell and generally conformed to the shape of the outer shell, said pad assembly including a left hand margin and a right hand margin, said margins extending outwardly beyond the lateral sides of the shell;

a flexible thigh attachment strap having a curved intermediate front section spaced longitudinally from the curved top side of the shell and spaced longitudinally from the pad assembly, said thigh attachment strap further including a left hand strap section and a right hand strap section with the front strap section extending therebetween, said left hand and right hand strap sections connectable behind the thigh to effect attachment of the thigh attachment strap to extend about the thigh of an individual with the front strap section extending across the front of the thigh, a first lateral side link connecting the shell and pad assembly to the thigh attachment strap at a flexible portion thereof, and a second lateral side link connecting the shell and pad assembly to the flexible thigh attachment strap at another flexible portion thereof, said first and second side links extending generally on opposite sides of the longitudinal axis; and first and second pad attachment straps attached respectively to the right hand margin and left hand margin and connectable to attach the shell and pad assembly over a patella so that the patella is not exposed and is covered and protected by the shell and pad assembly with the cushioning material of the pad assembly tightly engaged against the patella and surrounding region of the knee.

16. The knee pad of claim 15 wherein the first and second side links are generally rigid links with first and second attachment ends for connection respectively to the pad assembly and the thigh strap, at least one connection for each side link comprising a pivotal connection.

17. The knee pad of claim 15 wherein said pad assembly includes an interior face with a lip member extending at least partially circumferentially around the margins and the interior face of the pad assembly intermediate the margin.

18. A protective knee pad for workmen comprising, in combination:

a generally rigid formed knee protection shell, said shell including a generally concave interior, an interior peripheral edge, first and second lateral sides, an upper section configured to fit above the knee joint, said upper section having a generally convex exterior surface, a middle section configured to fit over the patella so that the patella is not exposed and is covered and protected by the shell, and a lower section extending downwardly configured to fit over the upper shin and having a lowermost edge portion configured in the form of a bill to extend outwardly away from the shin to avoid having the edge portion dig into the shin; and a flexible lower thigh strap configured and sized to extend entirely around a lower thigh and having opposite ends configured to be attached behind the thigh with a front flexible section of the flexible strap extending across the front of the thigh.

19. A protective knee pad for workmen comprising, in combination:

a first generally rigid formed shell, said shell including a concave interior, a pad assembly on the concave interior, an upper section of said pad assembly and shell configured to fit above the knee joint, a middle section of said pad assembly and shell configured to fit over the patella, and a lower section of said shell and pad assembly projecting downwardly configured to fit over the upper shin such that when worn, the first shell and pad assembly completely covers the wearer's patella;

a second generally lower thigh attachment member configured to fit around the lower thigh and above the first shell and pad assembly;

a first lateral side link flexibly attached at one end to a first lateral side of the first shell and attached at its opposite end to a lateral side of said thigh attachment member; and a second lateral side link flexibly attached at one end to a second lateral side of the first shell and attached at its opposite end to a lateral side of said thigh attachment member, said first and second links being locatable on generally opposite sides of a knee;

a first pivot connection, between the first lateral side link one end and the first shell first lateral side, and a second pivot connection between the second lateral side link one end and the first shell second lateral side with the first and second pivot connections being lateral aligned across the first shell from each other so that the first shell middle section is disposed to extend laterally therebetween in covering relation to the wearer's patella;

a protective shin guard, said shin guard having an upper end comprising a shin guard generally cylindrical shell and a longitudinal axis, said guard configured for fitting over the upper shin; and a flexible hinge joining the lower end of the knee shell to the upper end of the shin guard shell, said hinge generally flexible about an axis transverse to the longitudinal axis.

* * * * *